US010082293B2

(12) United States Patent
Matsui et al.

(10) Patent No.: US 10,082,293 B2
(45) Date of Patent: Sep. 25, 2018

(54) CERAMIC HEATER AND MANUFACTURING METHOD THEREOF

(75) Inventors: Kazuya Matsui, Nagoya (JP); Shindo Watanabe, Kitanagoya (JP)

(73) Assignee: NGK SPARK PLUG CO., LTD., Aichi (JP)

( * ) Notice: Subject to any disclaimer, the term of this patent is extended or adjusted under 35 U.S.C. 154(b) by 857 days.

(21) Appl. No.: 13/985,221

(22) PCT Filed: Apr. 18, 2012

(86) PCT No.: PCT/JP2012/060407
§ 371 (c)(1),
(2), (4) Date: Aug. 13, 2013

(87) PCT Pub. No.: WO2012/144503
PCT Pub. Date: Oct. 26, 2012

(65) Prior Publication Data

US 2013/0313244 A1 Nov. 28, 2013

(30) Foreign Application Priority Data

Apr. 19, 2011 (JP) ..... 2011-092902
Apr. 19, 2011 (JP) ..... 2011-092903

(51) Int. Cl.
*F23Q 7/22* (2006.01)
*H05B 3/00* (2006.01)
(Continued)

(52) U.S. Cl.
CPC ..... *F23Q 7/001* (2013.01); *H01C 17/02* (2013.01); *H05B 3/44* (2013.01); *F23Q 2007/004* (2013.01); *Y10T 29/49083* (2015.01)

(58) Field of Classification Search
CPC ... F23Q 2007/004; F23Q 7/001; H01C 17/02; H05B 3/44; Y10T 29/49083
(Continued)

(56) References Cited

U.S. PATENT DOCUMENTS 4,742,209 A * 5/1988 Minegishi ..... F23Q 7/001 123/145 A
5,750,958 A * 5/1998 Okuda ..... H01C 7/003 123/145 A
(Continued)

FOREIGN PATENT DOCUMENTS

JP 2000-130755 A 5/2000
JP 3171198 B2 5/2001
(Continued)

*Primary Examiner* — Dana Ross
*Assistant Examiner* — Ket D Dang
(74) *Attorney, Agent, or Firm* — Sughrue Mion, PLLC

(57) ABSTRACT

A ceramic heater including a columnar substrate and a heat generation resistor embedded in the substrate. A taper surface (12) having a contour L1 extending along an imaginary ellipse E is composed of a plurality of successively arranged curved surfaces which decrease in radius of curvature toward the forward end with respect to the direction of an axis P. The taper surface (12) is such that the distance between the end points M1 and M2 of the contour L1 is large in the direction of the axis P, and the angle between the axis P and a tangential line of the contour L1 on the side toward the forward end surface (11) is larger than the angle between the axis P and a tangential line of the contour L1 on the side toward the side circumferential surface (15).

13 Claims, 7 Drawing Sheets

(51) Int. Cl.
*F23Q 7/00* (2006.01)
*H05B 3/44* (2006.01)
*H01C 17/02* (2006.01)

(58) Field of Classification Search
USPC ..... 219/270, 267, 541, 543, 544, 145 A; 29/611; 123/145 A, 145 R; 361/264–266
See application file for complete search history.

(56) References Cited

U.S. PATENT DOCUMENTS 5,990,463 A * 11/1999 Shirai ..... G01N 27/4071 219/542
6,720,530 B2 * 4/2004 Taniguchi ..... F23Q 7/001 123/145 A
6,849,829 B1 * 2/2005 Otterbach ..... F23Q 7/001 123/145 A
7,351,935 B2 * 4/2008 Konishi ..... F23Q 7/001 123/145 A
2002/0130121 A1 * 9/2002 Taniguchi ..... F23Q 7/001 219/270
2002/0153365 A1 10/2002 Taniguchi et al.
2004/0188408 A1 * 9/2004 Kumada ..... F23Q 7/001 219/260
2010/0213188 A1 * 8/2010 Nishihara ..... F23Q 7/001 219/544
2011/0114622 A1 * 5/2011 Sekiguchi ..... F23Q 7/001 219/270

FOREIGN PATENT DOCUMENTS

JP 2002-270349 A 9/2002
JP 2002-364847 A 12/2002
JP WO 2009104401 A1 * 8/2009 ..... F23Q 7/001
JP 2010-73422 A 4/2010
WO 2009/104401 A1 8/2009

* cited by examiner

CERAMIC HEATER AND MANUFACTURING METHOD THEREOF

CROSS REFEREENCE TO RELATED APPLICATIONS

This application is a National Stage of International Application No. PCT/JP2012/060407, filed on Apr. 18, 2012, which claims priority from Japanese Patent Application Nos. 2011-092902 and 2011-092903, filed on Apr. 19, 2011, the contents of all of which are incorporated herein by reference in their entirety.

TECHNICAL FIELD

The present invention relates to a ceramic heater in which a heat generation resistor formed from an electrically conductive ceramic is embedded in a substrate formed from an insulating ceramic, and to a method of manufacturing the same.

BACKGROUND ART

A glow plug used for assisting in startup of a diesel engine includes a ceramic heater configured such that a heat generation resistor formed from an electrically conductive ceramic is embedded in a substrate formed from an insulating ceramic. In general, the heat generation resistor of the ceramic heater has the shape of the letter U, and a portion of the heat generation resistor corresponding to the turn portion of the letter U has a reduced diameter. Therefore, this portion functions as a heat generation portion. Further, a forward end portion of the substrate is formed into a semispherical shape which corresponds to the U-like shape of the heat generation portion. Therefore, the ceramic heater can efficiently transmit the heat generated by the heat generation portion to the outside of the substrate.

In recent years, in order to improve the startability of an engine and reduce $NO_x$ contained in exhaust gas, there has been a demand for increasing the rate of temperature rise after start of energization of a ceramic heater. In order to enhance the performance of a ceramic heater for raising temperature quickly (hereinafter referred to as "quick temperature raising performance") without changing the design of the heat generation resistor itself or changing the magnitude of current supplied to the heat generation resistor at the time of energization, the ceramic heater is desirably designed such that the heat generated by the heat generation portion is quickly transmitted to the outside of the substrate. A possible design which allows quick heat transmission is such that the outer diameter of the ceramic heater is made smaller than that of a conventional ceramic heater so as to dispose the heat generation resistor at a position closer to the outer surface of the substrate. However, merely decreasing the outer diameter of the ceramic heater may result in breakage of the ceramic heater. Therefore, a forward end portion of the substrate is desirably tapered such that the outer diameter of the ceramic heater decreases in a region corresponding to the heat generation portion (see, for example, Patent Document 1).

PRIOR ART DOCUMENT

Patent Document

Patent Document 1: Japanese Patent Application Laid-Open (kokai) No. 2002-270349

SUMMARY OF THE INVENTION

However, when the outer diameter of the ceramic heater is decreased, the surface area of the substrate decreases and heat radiation worsens. In addition, since the wall thickness of the substrate decreases, the thermal capacity in particular in the vicinity of the heat generation portion decreases. Therefore, if a forward end portion of the substrate is cooled by, for example, fuel adhering thereto or air flow within an engine, the heat generation portion is also cooled and its temperature drops, resulting in occurrence of a problem in that satisfactory quick temperature raising performance cannot be secured.

The present invention has been accomplished in order to solve the above-described problem, and its object is to provide a ceramic heater which has a satisfactory quick temperature raising performance, while rendering the heat radiation amount and thermal capacity of a forward end portion of a substrate sufficiently large, and to provide a method of manufacturing the ceramic heater.

According a first mode of the present invention, there is provided a ceramic heater comprising a columnar substrate made of insulating ceramic and extending in a direction of an axis; and a heat generation resistor made of electrically conductive ceramic, embedded in the substrate, and generating heat upon supply of electricity thereto, the heat generation resistor having a heat generation portion disposed in a forward end portion of the substrate with respect to the direction of the axis and lead portions extending toward a rear end of the substrate from opposite ends of the heat generation portion, wherein the forward end portion of the substrate has a taper portion formed such that the diameter of the taper portion decreases toward the forward end thereof with respect to the direction of the axis; the taper portion has an outer circumferential surface which is composed of a plurality of curved surfaces which bulge outward and have different radiuses of curvature, the curved surfaces being successively arranged in the direction of the axis such that the radius of curvature changes continuously; and of the plurality of curved surfaces, a forward curved surface formed on a forward side with respect to the direction of the axis is smaller in the radius of curvature than a rearward curved surface formed rearward of the forward curved surface with respect to the direction of the axis.

In the first mode, the outer circumferential surface of the taper portion is composed of a plurality of curved surfaces which bulge outward and are successively arranged in the direction of the axis. The plurality of successively arranged curved surfaces are formed such that the radius of curvature changes continuously, and the radius of curvature of a forward curved surface is smaller than that of a rearward curved surface. Namely, the plurality of curved surfaces which form the outer circumferential surface of the taper portion decrease in the radius of curvature toward the forward end. Thus, at the taper portion, the difference between the outer diameter of the substrate on the rear side with respect to the axial direction and that on the forward side can be maintained small up to a position closer to the forward end. Since the area of the outer surface of the substrate can be made larger by maintaining a diameter close to the outer diameter of the substrate up to a position closer to the forward end in the taper portion as described above, the heat radiation amount of the ceramic heater can be increased.

In the first mode, a condition of $2.3<D\leq3.3$ [mm] may be satisfied, where D represents an average outer diameter of the substrate in a portion thereof which extends 6 mm rearward from the position of a forward end of the substrate with respect to the direction of the axis. In the ceramic heater, when the average outer diameter D of the substrate in the 6 mm portion thereof which extends from the forward end of the substrate, which portion contributes heat generation is equal to or less than 2.3 mm, the surface area of the substrate decreases. Therefore, there arises a possibility that a heat radiation amount required to secure a satisfactory ignition performance at the time of startup of a diesel engine can not be obtained. When the average outer diameter D is greater than 3.3 mm, the distance between the heat generation resistor and the outer surface of the substrate increases, and the internal thermal capacity increases. Therefore, the ceramic heater requires a longer time to increase the internal temperature of the substrate and transmit the generated heat to the outside, and may fail to have a satisfactory quick temperature raising performance. Accordingly, by determining the average outer diameter D to satisfy the condition of $2.3<D\leq3.3$ [mm], the ceramic heater can have a satisfactory heat radiation amount and a satisfactory quick temperature raising performance.

In the first mode, a condition of B>A may be satisfied, where, on a cross section of the substrate containing the axis, A represents a shortest distance between the position of the forward end of the substrate and a reference position which is the position of a forward end of the heat generation resistor, and B represents a shortest distance between the reference position and an arbitrary position on the plurality of curved surfaces which forms the outer circumferential surface of the taper portion.

By satisfying the condition of B>A, the ceramic heater can be configured such that the wall thickness (thickness in the radial direction) of the substrate between the position (reference position) of the forward end of the heat generation resistor and the curved surface becomes greater than the wall thickness (thickness in the axial direction) of the substrate between the reference position and the forward end of the substrate. Namely, since the substrate can have a satisfactorily large outer diameter in a region between the heat generation resistor and the forward end of the substrate, the substrate can have a satisfactorily large surface area at the curved surface. Thus, the ceramic heater can radiate heat in an amount necessary for securing a satisfactory ignition performance at the time of startup of a diesel engine. Also, since a satisfactory thermal capacity can be secured by a securing a satisfactory volume at the forward end portion, even when the substrate is externally cooled, the influence of the cooling on the temperature drop of the heat generation resistor can be decreased, and the heat generation temperature can be readily maintained. In contrast, in the case where $B\leq A$, the wall thickness of the substrate between the reference position and the curved surface decreases as compared with the case where B>A. Namely, in the region between the heat generation resistor and the forward end of the substrate, the outer diameter of the substrate becomes smaller, and it becomes difficult for the substrate to have a sufficiently large surface area at the curved surface. Therefore, the heat radiation amount may decrease. Also, since it becomes difficult for the substrate to have a sufficiently large volume at the forward end portion, the thermal capacity of the forward end portion decreases. Therefore, when the substrate is externally cooled, the influence of the cooling on the temperature drop of the heat generation resistor may become greater.

In the first mode, a condition of $V\geq D\times20-21$ [$mm^3$] may be satisfied, where V represents the volume of the ceramic heater in a portion thereof which extends 6 mm rearward from the position of a forward end of the substrate with respect to the direction of the axis. When a glow plug using the ceramic heater is attached to an engine, the 6 mm portion of the substrate which extends from the forward end thereof projects into a combustion chamber and contributes heat generation. In the case where the relation between the volume V of the 6 mm portion of the substrate which extends from the forward end thereof and the average outer diameter D is such that $V<D\times20-21$, the performance of starting the engine may deteriorate in a certain environment (e.g., when the environmental temperature is low). Therefore, by satisfying the condition of $V\geq D\times20-21$, a satisfactory engine starting performance can be attained.

In the first mode, the ceramic heater may be configured such that the taper portion has a flat forward end surface perpendicular to the direction of the axis, a side circumferential surface which surrounds the axis in the circumferential direction, and a taper surface which is composed of the plurality of curved surfaces and which connects the forward end surface and the side circumferential surface so as to form a taper shape. When a cross section of the substrate containing the axis is viewed, a first contour which is the contour of the taper surface of the taper portion is such that a first end point at which the first contour is connected to a second contour which is the contour of the forward end surface is located forward in the direction of the axis of a second end point at which the first contour is connected to a third contour which is the contour of the side circumferential surface, and is located inward of the second end point in a radial direction perpendicular to the direction of the axis, the distance between the first end point and the second end point in the direction of the axis is greater than the distance between the first end point and the second end point in the radial direction, and an angle between the axis and a tangential line of the first contour at a position near the first end point is greater than an angle between the axis and a tangential line of the first contour at a position near the second end point.

In the first mode, when the first contour of the taper surface is considered, the taper surface is formed to satisfy the condition that the first end point is located forward of the second end point in the axial direction and is located inward of the second end point in the radial direction, the distance between the first and second end points is large in the axial direction, and the angle between the axis and a tangential line of the first contour on the side toward the forward end surface is larger than the angle between the axis and a tangential line of the first contour on the side toward the side circumferential surface. Namely, the taper surface of the first mode has a shape such that it bulges outward in the radial direction in relation to the line passing through the first and second end points, and the outer diameter of the substrate decreases from that at the second end point toward the first end point such that the rate of decrease increases gradually, rather than the outer diameter decreasing gradually at a constant rate. As a result, the difference between the outer diameter of the substrate measured on the taper surface and that measured on the side circumferential surface can be maintained small up to a point closer to the forward end. In other words, up to a point closer to the forward end, the taper surface can have an outer diameter close to the outer diameter of the substrate measured on the side circumferential surface. Accordingly, since the area of the outer surface of the substrate can be made sufficiently large, the heat generation amount of the ceramic heater can be increased.

Further, the volume of a portion of the substrate of the ceramic heater where the taper surface is formed can be increased. Therefore, as compared with a conventional ceramic heater having a semispherical forward end portion, the wall thickness of the substrate can be increased (i.e., a sufficient volume can be secured by securing a sufficient thickness in the radial direction) in particular at a position where the taper surface is formed. Therefore, the thermal capacity of the forward end portion of the ceramic heater can be increased as compared with the conventional ceramic heater. As a result, even when the ceramic heater is externally cooled, the influence of the cooling on the temperature drop of the heat generation resistor decreases, and maintaining the heat generation temperature becomes easier. Therefore, even when the outer diameter of the ceramic heater is decreased, its heat generation performance can be secured. If the heat generation resistor can be disposed closer to the outer surface of the ceramic heater through thinning, the heat generation performance of the ceramic heater can be improved further.

In the first mode, when an imaginary ellipse which has a major axis coinciding with the axis and which passes through the first and second end points is disposed on a cross section of the substrate containing the axis, the first contour may extend along the imaginary ellipse. When the taper surface is formed by R-chamfering and the first contour of the taper surface extends along the ellipse, no dihedral portion is formed on the taper surface, whereby chipping of the ceramic heater at the taper surface can be prevented.

In the first mode, the position of the center of the imaginary ellipse disposed on the cross section of the substrate containing the axis may be located rearward of the position of the forward end of the heat generation resistor with respect to the direction of the axis. Since the heat generation portion of the heat generation resistor can be disposed at a position closer to the forward end surface, heat can be radiated sufficiently from the forward end surface of the ceramic heater, whereby the heat generation performance of the ceramic heater can be enhanced.

In the first mode, when the imaginary ellipse is disposed on the cross section of the substrate containing the axis, the imaginary ellipse may be disposed on each of the opposite sides of the axis with respect to the radial direction such that the two imaginary ellipses are spaced from each other. When the size of the ellipses is determined such that they can be disposed away from each other, the first end point of the first contour can be rendered closer to the major axis side apex of the ellipse and the second end point of the first contour can be rendered closer to the minor axis side apex of the ellipse. Thus, the inclination of the tangential line which is tangent to the first contour at the first end point can be rendered close to the inclination of the tangential line of the second contour, and the inclination of the tangential line which is tangent to the first contour at the second end point can be rendered close to the inclination of the tangential line of the third contour. Thus, the first contour and the second contour can be smoothly connected to each other, and the first contour and the third contour can be smoothly connected to each other. Therefore, no dihedral portion is formed at the first end point or the second end point, and even when a dihedral portion is formed, the dihedral portion has an angle near 180 degrees as viewed on a cross section. Therefore, chipping of the ceramic heater which grows from the dihedral portion can be prevented more reliably.

According to a second mode of the present invention, there is provided a ceramic heater comprising a columnar substrate made of insulating ceramic and extending in a direction of an axis; and a heat generation resistor made of electrically conductive ceramic, embedded in the substrate, and generating heat upon supply of electricity thereto, the heat generation resistor having a heat generation portion disposed in a forward end portion of the substrate with respect to the direction of the axis and lead portions extending toward a rear end of the substrate from opposite ends of the heat generation portion, wherein the forward end portion of the substrate has a taper portion formed such that the diameter of the taper portion decreases toward the forward end thereof with respect to the direction of the axis; the taper portion has an outer circumferential surface which is composed of a plurality of sloping surfaces which have different sloping angles with respect to the axis and which are arranged along the direction of the axis; and of the plurality of sloping surfaces, a forward sloping surface formed on a forward side with respect to the direction of the axis is greater in the sloping angle than a rear sloping surface formed rearward of the forward sloping surface with respect to the direction of the axis.

In the second mode, the outer circumferential surface of the taper portion is composed of a plurality of sloping surfaces which have different sloping angles with respect to the axis and which are arranged along the direction of the axis. These sloping surfaces are formed such that the sloping angle of a forward sloping surface is larger than that of a rearward sloping surface. Namely, the plurality of sloping surfaces which form the outer circumferential surface of the taper portion increase in the sloping angle with respect to the axis toward the forward end. As a result of arrangement of these sloping surfaces along the axial direction, the taper portion has a shape such that the inclination angle of the contour of a cross section thereof with respect to the axis decreases gradually from the forward side toward the rear side. Thus, at the taper portion, the difference between the outer diameter of the substrate on the rear side with respect to the axial direction and that on the forward side can be maintained small up to a position closer to the forward end. Since the area of the outer surface of the substrate can be made larger by maintaining a diameter close to the outer diameter of the substrate up to a position closer to the forward end in the taper portion as described above, the heat radiation amount of the ceramic heater can be increased.

In the second mode, a condition of $2.3<D\leq3.3$ [mm] may be satisfied, where D represents an average outer diameter of the substrate in a portion thereof which extends 6 mm rearward from the position of a forward end of the substrate with respect to the direction of the axis. In the ceramic heater, when the average outer diameter D of the substrate in the 6 mm portion thereof which extends from the forward end of the substrate, which portion contributes heat generation is equal to or less than 2.3 mm, the surface area of the substrate decreases. Therefore, there arises a possibility that a heat radiation amount required to secure a satisfactory ignition performance at the time of startup of a diesel engine can not be obtained. When the average outer diameter D is greater than 3.3 mm, the distance between the heat generation resistor and the outer surface of the substrate increases, and the internal thermal capacity increase. Therefore, the ceramic heater requires a longer time to increase the internal temperature of the substrate and transmit the generated heat to the outside, and may fail to have a satisfactory quick temperature raising performance. Accordingly, by determining the average outer diameter D to satisfy the condition of $2.3<D\leq3.3$ [mm], the ceramic heater can have a satisfactory heat radiation amount and a satisfactory quick temperature raising performance.

In the second mode, a condition of B>A may be satisfied, where, on a cross section of the substrate containing the axis, A represents a shortest distance between the position of the forward end of the substrate and a reference position which is the position of a forward end of the heat generation resistor, and B represents a shortest distance between the reference position and an arbitrary position on the plurality of slping surfaces which forms the outer circumferential surface of the taper portion.

By satisfying the condition of B>A, the ceramic heater can be configured such that the wall thickness (thickness in the radial direction) of the substrate between the position (reference position) of the forward end of the heat generation resistor and the sloping surface becomes greater than the wall thickness (thickness in the axial direction) of the substrate between the reference position and the forward end of the substrate. Namely, since the substrate can have a satisfactorily large outer diameter in a region between the heat generation resistor and the forward end of the substrate, the substrate can have a satisfactorily large surface area at the sloping surface. Thus, the ceramic heater can radiate heat in an amount necessary for securing a satisfactory ignition performance at the time of startup of a diesel engine. Also, since a satisfactory thermal capacity can be secured by a securing a satisfactory volume at the forward end portion, even when the substrate is externally cooled, the influence of the cooling on the temperature drop of the heat generation resistor can be decreased, and the heat generation temperature can be readily maintained. In contrast, in the case where B≤A, the wall thickness of the substrate between the reference position and the sloping surface decreases as compared with the case where B>A. Namely, in the region between the heat generation resistor and the forward end of the substrate, the outer diameter of the substrate becomes smaller, and it becomes difficult for the substrate to have a sufficiently large surface area at the sloping surface. Therefore, the heat radiation amount may decrease. Also, since it becomes difficult for the substrate to have a sufficiently large volume at the forward end portion, the thermal capacity of the forward end portion decreases. Therefore, when the substrate is externally cooled, the influence of the cooling on the temperature drop of the heat generation resistor may become greater.

In the second mode, a condition of $V \geq D \times 20 - 21$ [$mm^3$] may be satisfied, where V represents the volume of the ceramic heater in a portion thereof which extends 6 mm rearward from the position of a forward end of the substrate with respect to the direction of the axis. When a glow plug using the ceramic heater is attached to an engine, the 6 mm portion of the substrate which extends from the forward end thereof projects into a combustion chamber and contributes heat generation. In the case where the relation between the volume V of the 6 mm portion of the substrate which extends from the forward end thereof and the average outer diameter D is such that $V < D \times 20 - 21$, the performance of starting the engine may deteriorate in a certain environment (e.g., when the environmental temperature is low). Therefore, by satisfying the condition of $V \geq D \times 20 - 21$, a satisfactory engine starting performance can be attained.

In the second mode, the ceramic heater may be configured such that the taper portion has a flat forward end surface perpendicular to the direction of the axis, a side circumferential surface which surrounds the axis in the circumferential direction, and a taper surface which is composed of the plurality of sloping surfaces and which connects the forward end surface and the side circumferential surface so as to form a taper shape. When a cross section of the substrate containing the axis is viewed, a first contour which is the contour of the taper surface of the taper portion is such that a first end point at which the first contour is connected to a second contour which is the contour of the forward end surface is located forward in the direction of the axis of a second end point at which the first contour is connected to a third contour which is the contour of the side circumferential surface, and is located inward of the second end point in a radial direction perpendicular to the direction of the axis, the distance between the first end point and the second end point in the direction of the axis is greater than the distance between the first end point and the second end point in the radial direction, and an angle between the axis and a tangential line of the first contour at a position near the first end point is greater than an angle between the axis and a tangential line of the first contour at a position near the second end point.

In the second mode, when the first contour of the taper surface is considered, the taper surface is formed to satisfy the condition that the first end point is located forward of the second end point in the axial direction and is located inward of the second end point in the radial direction, the distance between the first and second end points is large in the axial direction, and the angle between the axis and a tangential line of the first contour on the side toward the forward end surface is larger than the angle between the axis and a tangential line of the first contour on the side toward the side circumferential surface. Namely, the taper surface of the second mode has a shape such that it bulges outward in the radial direction in relation to the line passing through the first and second end points, and the outer diameter of the substrate decreases from that at the second end point toward the first end point such that the rate of decrease increases gradually, rather than the outer diameter decreasing gradually at a constant rate. As a result, the difference between the outer diameter of the substrate measured on the taper surface and that measured on the side circumferential surface can be maintained small up to a point closer to the forward end. In other words, up to a point closer to the forward end, the taper surface can have an outer diameter close to the outer diameter of the substrate measured on the side circumferential surface. Accordingly, since the area of the outer surface of the substrate can be made sufficiently large, the heat generation amount of the ceramic heater can be increased.

Further, the volume of a portion of the substrate of the ceramic heater where the taper surface is formed can be increased. Therefore, as compared with a conventional ceramic heater having a semispherical forward end portion, the wall thickness of the substrate can be increased (i.e., a sufficient volume can be secured by securing a sufficient thickness in the radial direction) in particular at a position where the taper surface is formed. Therefore, the thermal capacity of the forward end portion of the ceramic heater can be increased as compared with the conventional ceramic heater. As a result, even when the ceramic heater is externally cooled, the influence of the cooling on the temperature drop of the heat generation resistor decreases, and maintaining the heat generation temperature becomes easier. Therefore, even when the outer diameter of the ceramic heater is decreased, its heat generation performance can be secured. If the heat generation resistor can be disposed closer to the outer surface of the ceramic heater through thinning, the heat generation performance of the ceramic heater can be improved further.

In the second mode, all of the angle formed between a plurality of lines which constitute the first contour, the angle formed between the second contour and the first contour at the first end point, and the angle formed between the third contour and the first contour at the second end point may be 145 degrees or greater. In the case where the taper surface is formed by C-chamfering, dihedral portions are formed on the contour. However, when the angle at each dihedral portion (angle between adjacent lines of the contour) is 145 degrees or greater, chipping of the ceramic heater at the taper surface can be prevented effectively.

In the first or second mode, the third contour includes a fourth contour which extends from the second end point toward the rear side with respect to the direction of the axis while expanding in the radial direction, and a fifth contour which extends from the fourth contour in parallel with the direction of the axis; the second end point is disposed forward of the position of the forward end of the heat generation resistor with the direction of the axis; and a connection point between the fourth contour and the fifth contour is located rearward of the position of the forward end portion of the heat generation resistor with the direction of the axis.

Since a portion of the side circumferential surface (the fourth contour) which forms a taper shape is disposed such that the portion extends across the forward end position of the heat generation resistor, the heat generation portion of the heat generation resistor is disposed in the portion having a taper shape and is located closer to the outer surface of the substrate. Therefore, the heat generated at the heat generation portion can be efficiently radiated to the outside, whereby the heat generation performance of the ceramic heater can be enhanced.

In the first or second mode, a condition of $S1/S2\times100\geq27$ [%] may be satisfied, where S1 represents the area of the forward end surface, and S2 represents the area of a circle which has a diameter equal to the average outer diameter of the substrate in a portion thereof which extends 6 mm rearward from the position of the forward end of the substrate with respect to the direction of the axis. Since the smaller the area S1 of the forward end surface the greater the degree of decrease of the outer diameter of the substrate in the region where the taper surface is formed, it becomes difficult to maintain the outer diameter of the substrate in the region where the taper surface is formed, which raises a possibility that the surface area of the substrate at the taper surface cannot be secured sufficiently, and the heat radiation amount of the ceramic heater decreases. In the case where the condition of $S1/S2\times100\geq27$ [%] is satisfied, the surface area of the substrate of the ceramic heater especially at the taper surface can be made sufficiently large, whereby the ceramic heater can radiate heat in an amount necessary for securing a satisfactory ignition performance at the time of startup of a diesel engine.

According to a third mode of the present invention, there is provided a method of manufacturing a ceramic heater according to the first or second mode, the method comprising a first grinding step of grinding a side surface and an end surface of a columnar fired body in which the substrate) and the heat generation resistor are fired and united, to thereby form the side circumferential surface parallel to the axis and the forward end surface perpendicular to the axis; a second grinding step of grinding a dihedral portion formed between the forward end surface and the side circumferential surface of the fired body to thereby form the taper surface; and a third grinding step of grinding a forward end portion of the side circumferential surface including a portion thereof which is connected to the taper surface, so as to form a taper shape such that the diameter decreases toward the forward end. When the ceramic heater is ground through these steps so as to form the taper surface, a ceramic heater which provides effects similar to those of the first or second mode can be readily manufactured.

MODES FOR CARRYING OUT THE INVENTION

Figure 1:
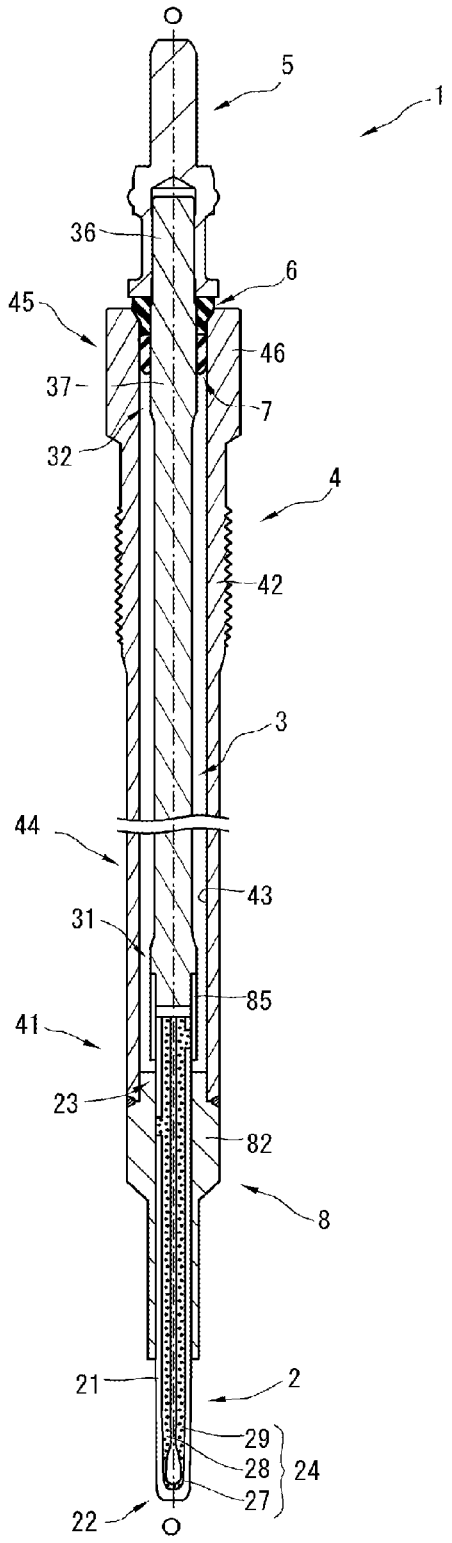
FIG. 1 Longitudinal sectional view of a glow plug 1.
Figure 2:
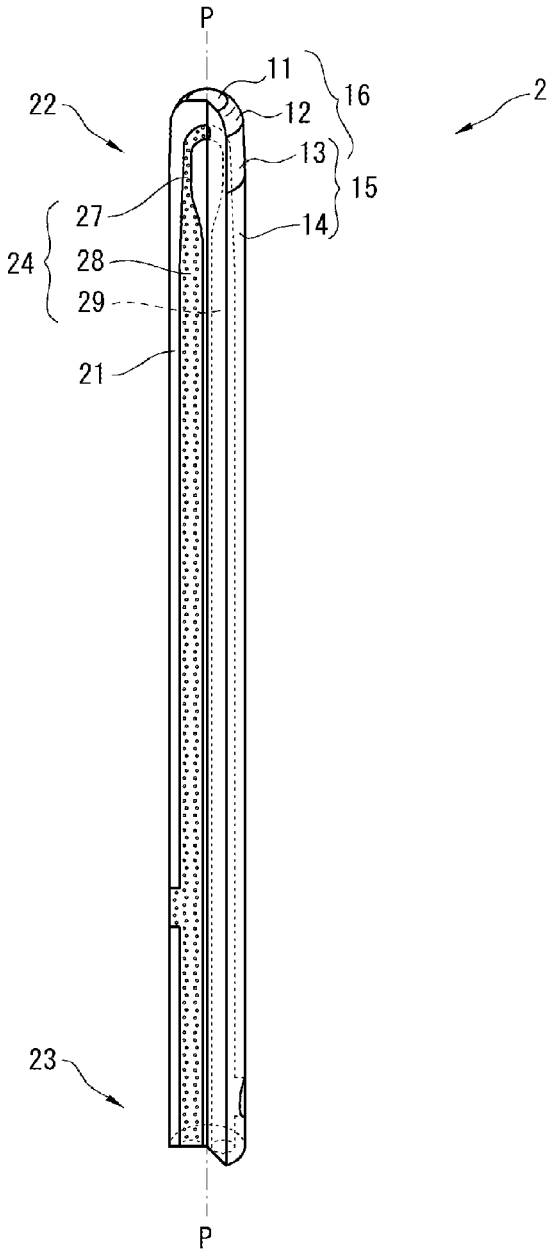
FIG. 2 Partially sectioned perspective view of a ceramic heater 2.

Embodiments of a ceramic heater according to the present invention and a method of manufacturing the same will next be described with reference to the drawings. The structure of a glow plug 1 will be described with reference to FIGS. 1 and 2 in which a ceramic heater 2 provided in the glow plug 1 is shown as an example of the ceramic heater according to the present invention. The drawings referred to herein are used for explaining technical features which the present invention can employ, and the configuration, etc., of the glow plug appearing in the drawings are given by way of illustration and not of limitation. In the following description, the axis of a metallic shell 4 is referred to as the axis O, and the axis O serves as reference in describing the positional relationship, orientations, and directions of those component members of the glow plug 1 which are attached to the metallic shell 4. In FIG. 1, with respect to the extending direction of the axis O (hereinafter, may be referred to as "the direction of the axis O"), a side on which the ceramic heater 2 is disposed (the lower side in FIG. 1) is referred to as the forward side of the glow plug 1. In FIG. 2, the axis of the ceramic heater 2 in a state prior to attachment to the glow plug 1 is illustrated as an axis P, and a side on which a heat generation portion 27 of a heat generation resistor 24 is disposed (the upper side in FIG. 2) is referred to as the forward side of the ceramic heater 2.

The glow plug 1 shown in FIG. 1 is attached to, for example, a combustion chamber of a direct-injection-type diesel engine (not shown), and is used as a heat source for assisting in ignition at startup of an engine. The glow plug 1 includes the metallic shell 4, a holding member 8, the ceramic heater 2, a center shaft 3, a connection terminal 5, an insulation member 6, a seal member 7, and a connection ring 85.

First, the ceramic heater 2 is described. The ceramic heater 2 is configured such that a heat generation resistor 24 which is formed from an electrically conductive ceramic and which generates heat upon supply of electricity thereto is embedded in a substrate 21 formed from an insulating ceramic. As shown in FIG. 2, the ceramic heater 2 assumes the form of a round bar extending along the axis P, and a forward end surface 11 which is an end surface of a forward end portion 22 of the ceramic heater 2 is a flat surface perpendicular to the axis P. A dihedral portion between the forward end surface 11 and a side circumferential surface 15 surrounding the axis P in the circumferential direction is chamfered (rounded) by R-chamfering so as to form a taper surface 12 which connects the surface 11 and the side circumferential surface 15 such that the diameter of the ceramic heater decreases toward the forward end thereof.

The side circumferential surface 15 of the ceramic heater 2 is composed of a first side circumferential surface 13 which is formed on the forward end portion 22 and is tapered such that its diameter decreases toward the forward end, and a second side circumferential surface 14 which is formed rearward of the first side circumferential surface 13 and which is not tapered. The tapered first side circumferential surface 13 is formed by chamfering (C-chamfering) the dihedral portion between the side circumferential surface 15 and the taper surface 12, and connects the taper surface 12 and the second side circumferential surface 14 (an unchamfered portion of the side circumferential surface 15). The forward end surface 11, the taper surface 12, and the first side circumferential surface 13 gradually reduce the outer diameter of the forward end portion 22 of the substrate 21 toward the forward side with respect to the direction of the axis P. Therefore, in the following description, the forward end surface 11, the taper surface 12, and the first side circumferential surface 13 are collectively referred to a taper portion 16. Although not illustrated in the drawing, the edge of a rear end portion 23 of the ceramic heater 2 is also chamfered (C-chamfering).

The heat generation resistor 24 embedded in the substrate 21 of the ceramic heater 2 is formed from an electrically conductive ceramic and has a substantially U-shaped cross section. The heat generation resistor 24 includes a heat generation portion 27 and lead portions 28 and 29. The heat generation portion 27 is formed to have a generally U-like shape and is disposed in the forward end portion 22 of the substrate 21 such that a portion of the heat generation portion 27 corresponding to the turn portion of the letter U is directed forward. The lead portions 28 and 29 are connected to opposite ends (the opposite ends of the U-like shape), respectively, of the heat generation resistor 27 and extend substantially in parallel with each other toward the rear end portion 23 of the ceramic heater 2. The cross-sectional area of the heat generation portion 27 is smaller than that of each of the lead portions 28 and 29, and, upon energization, heat is generated mainly by the heat generation portion 27. In a region which extends rearward from the center of the ceramic heater 2, the lead portions 28 and 29 are exposed from the outer circumferential surface of the substrate 21 at positions deviated from each other in the direction of the axis O.

Next, the holding member 8 is described. The holding member 8 is a cylindrical metal member extending in the direction of the axis O and radially holds a trunk portion of the ceramic heater 2. The holding member 8 is electrically connected to the exposed portion of the lead portion 28 of the ceramic heater 2 within a tubular hole of the holding member 8. The forward end portion 22 and the rear end portion 23 of the ceramic heater 2 project from the opposite ends, respectively, of the tubular hole of the holding member 8. A flange portion 82 having a large wall thickness is formed at the rear end side of the holding member 8, and a forward end portion 41 of the metallic shell 4 which will be described later is joined to the flange portion 82.

Also, the tubular connection ring 85 of metal is press-fitted to the rear end portion 23 of the ceramic heater 2 projecting rearward from the holding member 8. The exposed portion of the lead portion 29 of the ceramic heater 2 is electrically connected to the connection ring 85. A forward end portion 31 of the center shaft 3 which will be described later is joined to the connection ring 85.

Next, the metallic shell 4 is described. The metallic shell 4 is a slender tubular metal member having an axial bore 43 extending therethrough in the direction of the axis O. The inner circumference of the forward end portion 41 of the metallic shell 4 is fitted onto the flange portion 82 of the holding member 8. Portions of the forward end portion 41 and the flange portion 82 which butt each other are laser-welded, whereby the metallic shell 4 is united with the holding member 8, and is electrically connected thereto. Thus, the metallic shell 4 is electrically connected to the lead portion 28 of the ceramic heater 2 through the holding member 8. Also, a mounting portion 42 is provided on a trunk portion 44 of the metallic shell 4 which is located between the forward end portion 41 and the rear end portion 45. The mounting portion 42 has threads for mounting the glow plug 1 to an engine head of an internal combustion engine (not shown). A hexagonal tool engagement portion 46 is formed on the rear end portion 45 of the metallic shell 4. A tool used for mounting the glow plug 1 to the engine head is engaged with the tool engagement portion 46.

Next, the center shaft 3 is described. The center shaft 3 is a rodlike metal member extending in the direction of the axis O and is inserted into the axial bore 43 of the metallic shell 4 such that the center shaft 3 is insulated from the metallic shell 4. A forward end portion 31 of the center shaft 3 is engaged with the inner circumference of the connection ring 85, is unitarily joined thereto by laser welding, and is electrically connected thereto. Thus, the center shaft 3 is electrically connected to the lead portion 29 of the ceramic heater 2 through the connection ring 85. The rear end portion 32 of the center shaft 3 has a connection end portion 36 which projects rearward from the rear end portion 45 of the metallic shell 4, and a connection base portion 37 disposed in the rear end portion 45.

The seal member 7, which a cylindrical tubular member formed from an electrically insulative material having elasticity such as fluororubber, is disposed between the inner circumferential surface of the axial bore 43 of the metallic shell 4 and the outer circumferential surface of the connection base portion 37 of the center shaft 3. The seal member 7 holds the rear end portion 32 of the center shaft 3 in the axial bore 43 to thereby restrain oscillation of the center shaft 3, and maintains the gastightness of the interior of the axial bore 43. Also, the insulation member 6, which is a tubular member formed from a heat-resistant, electrically insulative material such as nylon (registered trademark), is disposed rearward of the seal member 7. In order to prevent formation of a short circuit due to contact among the metallic shell 4, the center shaft 3, and the connection terminal 5 (which will be described later), the insulation member 6 is fitted on the rear end portion 32 of the center shaft 3 such that it is disposed in the opening of the rear end portion 45 of the metallic shell 4.

The connection terminal 5 is fixed to the connection end portion 36 of the center shaft 3 by means of crimping. After the glow plug 1 is attached to the engine head (not shown), a plug cap (not shown) is fitted to the connection terminal 5.

One end (on the side toward the lead portion 29) of the heat generation resistor 24 of the ceramic heater 2 is connected to the plug cap through the connection terminal 5 and the center shaft 3. The other end (on the side toward the lead portion 28) of the heat generation resistor 24 is connected to the engine through the holding member 8 and the metallic shell 4. When electricity is supplied between the connection terminal 5 and the metallic shell 4, the heat generation portion 27 generates heat.

Figure 3:
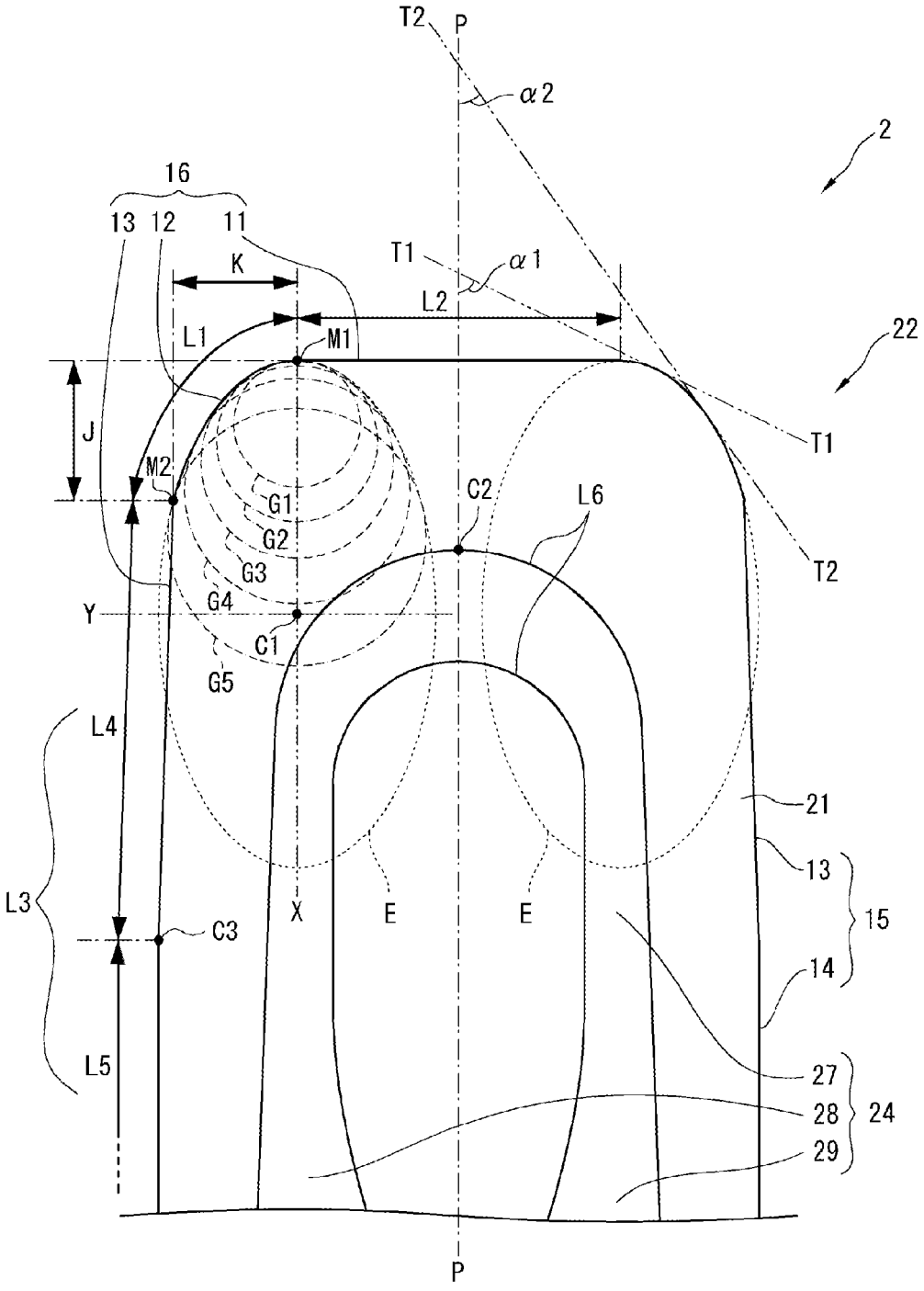
FIG. 3 Enlarged view of a forward end portion 22 of the ceramic heater 2 which shows the contour of a cross section of the ceramic heater 2 containing the axis P thereof.

In order that the ceramic heater 2 used in, for example, the glow plug 1 having the above-described structure can have a satisfactory thermal capacity and a satisfactory quick temperature raising performance, in the present embodiment, the shape of the forward end portion 22 of the ceramic heater 2 is specified as follows. First, as viewed on a cross section of the forward end portion 22 of the ceramic heater 2 which contains the axis P as shown in FIG. 3, the forward end surface 11 has a contour L2, the taper surface 12 has a contour L1, and the side circumferential surface 15 has a contour L3. A portion of the contour L3 of the side circumferential surface 15 which corresponds to the first side circumferential surface 13 of the side circumferential surface 15 is illustrated as a contour L4, and a portion of the contour L3 which corresponds to the second side circumferential surface 14 of the side circumferential surface 15 is illustrated as a contour L5. Of the opposite end points of the contour L1, the end point on the side toward the contour L2 is denoted by M1, and the end point on the side toward the contour L3 (on the side toward the contour L4) is denoted by M2. Notably, in the following description, the upper side of FIG. 3 where the contour L2 of the forward end surface 11 of the ceramic heater 2 is depicted is referred to as the "forward side" with respect to the direction of the axis P.

The ceramic heater 2 satisfies condition <1> that the end point M1 is located forward of the end point M2 as viewed in the direction of the axis P, and condition <2> that the end point M1 is located inward of the end point M2 (is located closer to the axis P) as viewed in the radial direction. Also, the distance between the end point M1 and the end point M2 in the direction of the axis P is denoted by J, and the distance between the end point M1 and the end point M2 in the radial direction (the direction orthogonal to the axis P) is denoted by K. The ceramic heater 2 also satisfies condition <3> that the distance J is greater than the distance K. Moreover, of two arbitrary tangential lines of the contour L1, one tangential line which passes through a point of contact closer to the end point M1 is denoted by T1, and the other tangential line which passes through a point of contact closer to the end point M2 is denoted by T2. The ceramic heater 2 also satisfies condition <4> that the angle $\alpha 1$ between the tangential line T1 and the axis P is greater than the angle $\alpha 2$ between the tangential line T2 and the axis P.

When conditions <1> and <2> are satisfied, the end point M1 located on the forward side is located forward (with respect to the direction of the axis P) of the end point M2 located on the rearward side and is located inward of the end point M2 in the radial direction. When condition <4> is satisfied, the contour L1 bulges outward in the radial direction in relation to at least a line passing through the end points M1 and M2 such that the contour L1 has two or more different tangential lines. Moreover, when condition <3> is satisfied, the size of the substrate 21 in the radial direction can be maintained up to a position closer to the forward end with respect to the direction of the axis P as compared with the case where the distance J is equal to or less than the distance K. That is, the taper surface 12 has a shape such that it bulges outward in the radial direction in relation to the line passing through the end points M1 and M2, and the outer diameter of the substrate 21 decreases from the end point M2 toward the end point M1 such that the rate of decrease increases gradually, rather than the outer diameter decreasing gradually at a constant rate. As a result, the difference between the outer diameter of the substrate 21 measured on the taper surface 12 and that measured on the side circumferential surface 15 can be maintained small to a point closer to the forward end. In other words, up to a point closer to the forward end, the taper surface 12 can have an outer diameter close to the outer diameter of the substrate 21 measured on the side circumferential surface 15. When the outer diameter of the substrate 21 is reduced through thinning, the outer diameter in particular at the taper surface 12 becomes smaller and the area of the outer surface of the substrate 21 also decreases. However, since the area of the outer surface of the substrate 21 can be made sufficiently large by securing a diameter close to the outer diameter of the substrate 21 measured on the side circumferential surface 15 up to a point closer to the forward end of the taper surface 12, the heat generation amount of the ceramic heater 2 can be increased.

Further, the volume of a portion of the substrate 21 of the ceramic heater 2 where the taper surface 12 is formed can be increased. Therefore, as compared with a conventional ceramic heater having a semispherical forward end portion, the wall thickness of the substrate 21 can be increased (i.e., a sufficient volume can be secured by securing a sufficient thickness in the radial direction) in particular at a position (in the direction of the axis P) where the taper surface 12 is formed. Therefore, the thermal capacity of the forward end portion 22 of the ceramic heater 2 can be increased as compared with the conventional ceramic heater. As a result, even when the ceramic heater 2 is externally cooled, the influence of the cooling on the temperature drop of the heat generation resistor 24 decreases, and maintaining the heat generation temperature becomes easier. Therefore, even when the outer diameter of the ceramic heater 2 is decreased, its heat generation performance can be secured. If the heat generation resistor 24 can be disposed closer to the outer surface of the ceramic heater 2 through thinning, the heat generation performance of the ceramic heater 2 can be improved further.

Furthermore, in the present embodiment, the ceramic heater 2 satisfies condition <5> that the contour L1 of the taper surface 12 extends along an imaginary ellipse E passing through the end points M1 and M2. The ellipse E which passes through the end points M1 and M2 and which enables the shape of the contour L1 to satisfy the above-described conditions <1> to <4> has a major axis X parallel to the axis P and a minor axis Y orthogonal to the axis P. The taper surface 12 extending along such an ellipse E can be formed by rounding (R-chamfering). Therefore, the taper surface 12 has no dihedral portion, whereby chipping of the ceramic heater 2 at the taper surface 12 can be prevented.

The ceramic heater 2 also satisfies condition <6> that the position C1 of the center point (the intersection between the major axis X and the minor axis Y) of the imaginary ellipse E is located rearward of the forward end position C2 of the heat generation resistor 24 with respect to the direction of the axis P. The forward end position C2 of the heat generation resistor 24 is a position in the direction of the axis P where the apex of the contour L6 of the heat generation resistor 24 embedded in the substrate 21 is present. Since the heat generation resistor 24 has a U-like shape, the forward end position C2 is usually located on the axis P, and, irrespective of the orientation of the heat generation resistor 24 within the substrate 21 with respect to the circumferential direction around the axis P, the forward end position C2 is univocally determined on the cross section containing the axis P. By determining the shape of the forward end portion 22 of the ceramic heater 2 such that the conditions <1> to <5> are satisfied and the forward end position C2 is located forward of the position C1 of the center of the ellipse E (i.e., is located within the semi-major axis (the radius of the major axis) of the ellipse E), the heat generation portion 27 of the heat generation resistor 24 can be disposed closer to the forward end surface 11. Therefore, heat can be radiated to a sufficient degree from the forward end surface 11 of the ceramic heater 2 as well, whereby the heat generation performance of the ceramic heater 2 can be enhanced.

Also, the ellipse E is specified by condition <7> that two ellipses E imaginarily disposed on opposite sides of the axis P in the radial direction do not overlap each other and are separated from each other. Namely, the semi-minor axis (the radius of the minor axis) of the ellipse E is smaller than the distance between the position C1 of the center of the ellipse E and the axis P. When the size of the ellipses E is determined such that they can be disposed away from each other, the end point M1 of the contour L1 can be rendered close to the major axis side apex of the ellipse E and the end point M2 of the contour L1 can be rendered close to the minor axis side apex of the ellipse E. Thus, the inclination of the tangential line which is tangent to the contour L1 at the end point M1 can be rendered close to the inclination of the tangential line of the contour L2, and the inclination of the tangential line which is tangent to the contour L1 at the end point M2 can be rendered close to the inclination of the tangential line of the contour L3. Thus, the contour L1 and the contour L2 can be smoothly connected to each other, and the contour L1 and the contour L3 can be smoothly connected to each other. Therefore, no dihedral portion is formed at the end point M1 or the end point M2, and even when a dihedral portion is formed, the dihedral portion has an angle near 180 degrees as viewed on a cross section.

As will be described later, the ceramic heater 2 is fired in the firing step of its manufacturing process by a known hot press method in which the ceramic heater 2 is contracted in the radial direction and expanded in the direction of the axis P due to compressive deformation. Therefore, the orientations of ceramic particles which constitute the substrate 21 are aligned in a planar direction perpendicular to the pressing direction at the time of the hot pressing. Therefore, if a dihedral portion remains at the end point M1 or the end point M2, cracking may start from the dihedral portion and grow along the direction of the axis P when an external force acts on the forward end surface 11. Therefore, by preventing formation of a dihedral portion at the end point M1 or the end point M2 to a possible extent, it become possible to more reliably prevent occurrence of chipping of the ceramic heater 2 which would otherwise start from the dihedral portion.

In the present embodiment, the ceramic heater 2 satisfies condition <8> that the end point M2 is located forward of the forward end position C2. Further, the ceramic heater 2 satisfies condition <9> that the connection point C3 between the contour L4 of the first side circumferential surface 13 and the contour L5 of the second side circumferential surface 14 is located rearward of the forward end position C2 in the direction of the axis P. The end point M2 and the connection point C3 are the opposite ends of the contour L4. Also, the contour L4 is the contour of the first side circumferential surface 13, which is a portion of the side circumferential surface 15 and is tapered at the forward end portion 22 such that its diameter decreases toward the forward end. Namely, the forward end position C2 faces the first side circumferential surface 13 in the radial direction. Therefore, the heat generation portion 27 of the heat generation resistor 24 also faces the first side circumferential surface 13 in the radial direction, and is located close to the outer surface of the substrate 21. Accordingly, heat generated by the heat generation portion 27 can be efficiently radiated to the outside, whereby the heat generation performance of the ceramic heater 2 can be enhanced.

Notably, in the above-mentioned condition <5>, the shape of the taper surface 12 of the taper portion 16 is specified, with attention being paid to the contour L1, such that the contour L1 extends along the imaginary ellipse E. The surface shape of the taper surface 12 can be further specified by condition <10–1> that the taper surface 12 is composed of a plurality of successive curved surfaces having different radiuses of curvature such that a forward side curved surface is smaller in radius of curvature than a rear side curved surface. Specifically, as shown in FIG. 3, when the radiuses of curvature of the plurality of successive curved surfaces which form the taper surface 12 are compared, it is found that the closer toward the forward end in the direction of the axis P, the smaller the radius of curvature of the curved surface. For example, the radiuses of curvature G2, G3, G4, and G5 of the curved surfaces located rearward (in the direction of the axis P) of the curved surface having a radius of curvature G1 (the radius of a circle indicated by an alternate long and short dash line G1 in FIG. 3) are greater than the radius of curvature G1. Similarly, the radiuses of curvature G3, G4, and G5 of the curved surfaces located rearward (in the direction of the axis P) of the curved surface having the radius of curvature G2 are greater than the radius of curvature G2. The taper surface 12, which is formed by an infinite number of curved surfaces whose radiuses of curvature are determined to decrease toward the forward end in the direction of the axis P as described above, has a shape such that the outer diameter of the substrate 21 decreases toward the forward end in the direction of the axis P with the diameter decreasing at a gradually increasing rate as in the above-described case. Therefore, a diameter close to the outer diameter of the substrate 21 can be maintained up to a point closer to the forward end of the taper surface 12, and the area of the outer surface of the substrate 21 can be secured, whereby a larger quantity of heat can be radiated from the ceramic heater 2. Since such taper surface 12 is formed by rounding (R-chamfering), no dihedral portion is formed, and chipping of the ceramic heater 2 at the taper surface 12 can be prevented.

When the shape of the taper portion 16 composed of the forward end surface 11, the taper surface 12, and the first side circumferential surface 13 satisfies the above-described conditions <1> to <10–1>, the ceramic heater 2 can have a satisfactory quick temperature raising performance while securing a satisfactory thermal capacity at the forward end portion 22. Also, in the present embodiment, a satisfactory quick temperature raising performance and a satisfactory thermal capacity at the forward end portion 22 are secured by specifying the sizes, areas, volumes, etc., of various sections of the forward end portion 22 of the ceramic heater 2 as follows.

Figure 4:
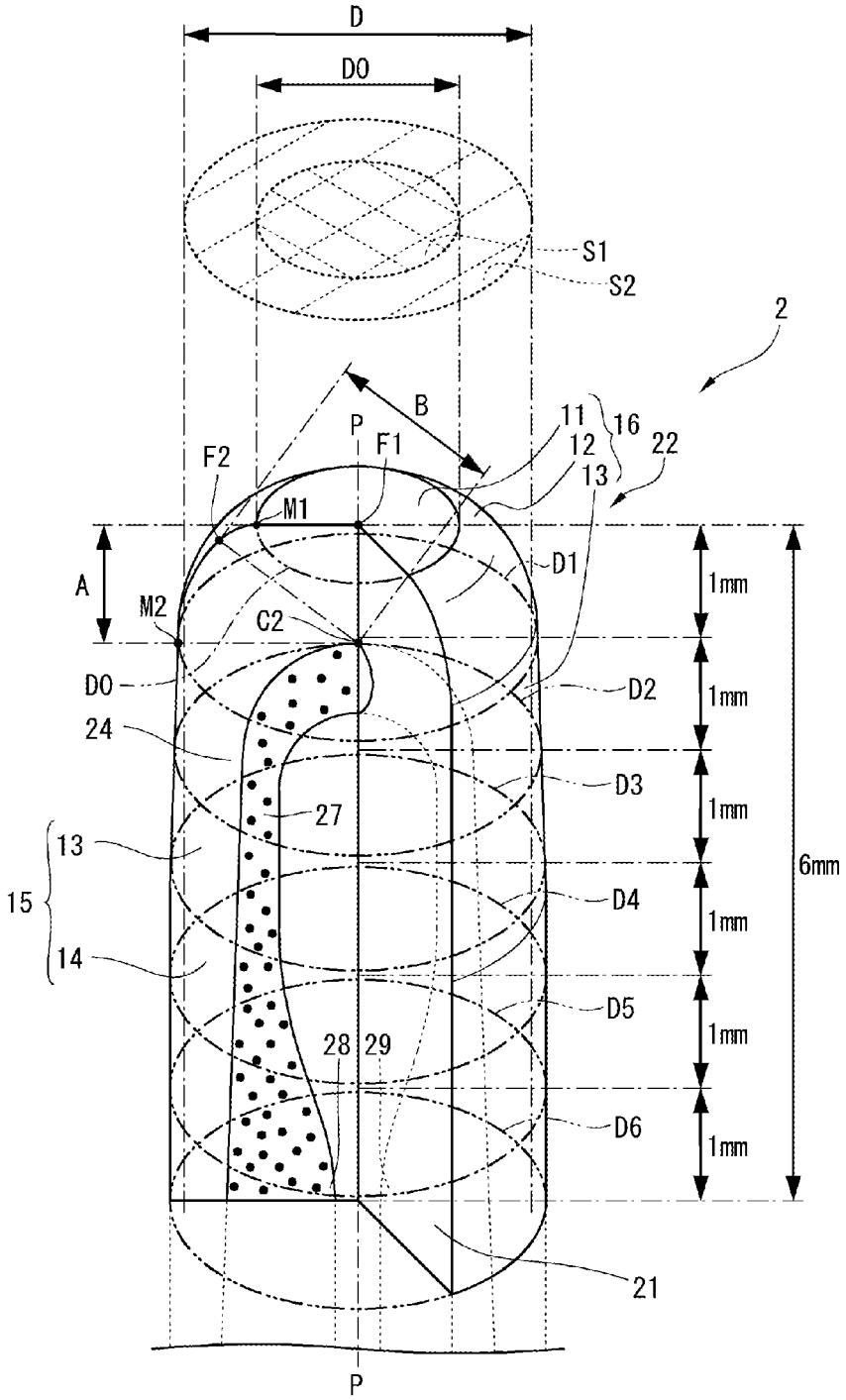
FIG. 4 Partially sectioned perspective view of a portion of the ceramic heater 2 extending 6 mm from the forward end thereof.

As shown in FIG. 4, attention is paid to a section of the forward end portion 22 of the ceramic heater 2 which extends 6 mm rearward (in the direction of the axis P) from the position of the forward end surface 11 (hereinafter also referred to as the "conditions specified section") (indicated by a solid line in FIG. 4). The average outer diameter of the ceramic heater 2 at this conditions specified section is denoted by D. Specifically, the average outer diameter D is the average of an outer diameter D0 measured at the position of the forward end surface 11 and outer diameters D1 to D6 measured at intervals of 1 mm along the direction of the axis P up to a position which is separated 6 mm away from the forward end surface 11. The reason why attention is paid to the 6 mm section from the forward end surface 11 as the conditions specified section is that when the glow plug 1 using the ceramic heater 2 is attached to an engine, in general, a portion which extends about 6 mm from the forward end surface 11 projects into a combustion chamber and contributes to ignition.

First, in the present embodiment, the ceramic heater 2 satisfies condition <11> that the average outer diameter D of the conditions specified portion satisfies $2.3<D\leq3.3$ [mm]. According to Example 1 to be described later, when the average outer diameter D is equal to or less than 2.3 mm, the surface area of the substrate 21 decreases, which may result in a failure to radiate heat in an amount necessary for securing a satisfactory ignition performance at the time of startup of a diesel engine. Meanwhile, when the average outer diameter D is greater than 3.3 mm, the heat generation resistor 24 separates away from the outer surface of the substrate 21 and the internal thermal capacity of the substrate 21 increases. Therefore, a longer time is needed to raise the interior temperature of the substrate 21 and transmit the generated heat to the outside, which may result in failure to attain a satisfactory quick temperature raising performance. By satisfying condition <11>, the ceramic heater 2 can secure a satisfactory heat radiation amount and a satisfactory quick temperature raising performance.

Next, an imaginary circle (indicated by a broken line in FIG. 4) whose diameter is equal to the average outer diameter D is assumed, and the area of the imaginary circle is denoted by S2. Also, the area of the forward end surface 11 (whose diameter is the above-mentioned outer diameter D0) is denoted by S1. The ceramic heater 2 satisfies condition <12> that the ratio of the area S1 to the area S2 is 27% or greater. Since the smaller the area S1 of the forward end surface 11, the greater the degree of decrease of the outer diameter of the substrate 21 in the region where the taper surface 12 is formed, it becomes difficult to maintain the outer diameter of the substrate 21 in the region where the taper surface 12 is formed, which raises a possibility that the surface area of the substrate 21 at the taper surface 12 cannot be secured sufficiently, and the heat radiation quantity of the ceramic heater 2 decreases.

According to Example 2 to be described later, when the ratio of the area S1 to the area S2 is less than 27%, the ceramic heater 2 may fail to radiate heat in an amount necessary for securing a satisfactory ignition performance at the time of startup of the diesel engine. Notably, in order to secure a satisfactory ignition performance at the time of startup of the engine, a portion which extends 4 mm rearward (in the direction of the axis P) from the position of the forward end surface 11 must generate heat in an amount of 13 W or greater. Also, when the outer diameter of the substrate 21 decreases in the region where the taper surface 12 is formed, as described above, the substrate 21 cannot have a sufficient wall thickness (thickness in the radial direction; i.e., volume). Thus, the thermal capacity of the forward end portion 22 of the ceramic heater 2 decreases. Therefore, when the substrate 21 is externally cooled, the influence of the cooling on the temperature drop of the heat generation resistor 24 increases, and maintaining the heat generation temperature may become difficult. By satisfying condition <12>, the ceramic heater 2 can have a satisfactory heat radiation amount and a satisfactory thermal capacity at the forward end portion 22.

Next, as shown in FIG. 4, on the cross section of the substrate 21, the forward end position C2 of the heat generation resistor 24 (with respect to the direction of the axis P) is defined as a reference position. On this cross section, the shortest distance between the forward end position C2 (reference position) and the position of the forward end surface 11 is denoted by A. As described above, the forward end position C2 is usually located on the axis P, and the forward end surface 11 is usually formed on a plane perpendicular to the axis P. When the position of the forward end surface 11 on the axis P is denoted by F1, the distance between the forward end position C2 and the position F1 corresponds to the shortest distance A. Also, on the cross section of the substrate 21, an arbitrary position on the taper surface 12 is denoted by F2. On the cross section, the shortest distance between the forward end position C2 (the reference position) and the position F2 is denoted by B. In the present embodiment, the ceramic heater 2 satisfies condition <13> that B>A.

By satisfying the condition of B>A, the ceramic heater 2 can be configured such that the wall thickness (thickness in the radial direction) of the substrate 21 between the forward end position C2 and the taper surface 12 becomes greater than the wall thickness (thickness in the axial direction) of the substrate 21 between the reference position (the forward end position C2) and the forward end surface 11. Namely, since the substrate 21 can have a satisfactorily large outer diameter in a region between the forward end of the substrate 21 and the forward end position C2; i.e., the heat generation resistor 24, the substrate 21 can have a satisfactorily large surface area at the taper surface 12. Thus, the ceramic heater 2 can radiate heat in an amount necessary for securing a satisfactory ignition performance at the time of startup of the diesel engine. Also, since a satisfactory thermal capacity can be secured by a securing a satisfactory volume at the forward end portion 22, even when the substrate 21 is externally cooled, the influence of the cooling on the temperature drop of the heat generation resistor 24 can be decreased, and the heat generation temperature can be readily maintained. In contrast, in the case where B≤A, the wall thickness of the substrate 21 between the forward end position C2 and the taper surface 12 decreases as compared with the case where B>A. Namely, in the region between the heat generation resistor 24 and the forward end of the substrate 21, the outer diameter of the substrate 21 becomes smaller, and it becomes difficult for the substrate 21 to have a sufficiently large surface area at the taper surface 12. Therefore, heat radiation amount may decrease. Also, since it becomes difficult for the substrate 21 to have a sufficiently large volume at the forward end portion 22, the thermal capacity of the forward end portion 22 decreases. Therefore, when the substrate 21 is externally cooled, the cooling affects the temperature drop of the heat generation resistor 24 more greatly.

According to Example 3 to be described later, a ceramic heater 2 which includes a substrate 21 in which the distance B is equal to or less than the distance A (B≤A) may fail to radiate heat in the amount (13 W or more) necessary for securing a satisfactory ignition performance at the time of startup of a diesel engine. In the case where the distance B is equal to or less than the distance A (B≤A) and the substrate 21 does not have a sufficient wall thickness in the region where the taper surface 12 is formed, the thermal capacity of the forward end portion 22 of the ceramic heater 2 decreases.

Like the above-described case, when the substrate 21 is externally cooled, the cooling affects the temperature drop of the heat generation resistor 24 more greatly, and maintaining the heat generation temperature may become difficult. By satisfying condition <13>, the ceramic heater 2 can have a satisfactory heat radiation amount and a satisfactory thermal capacity at the forward end portion 22.

Next, the volume of the ceramic heater 2 at the conditions specified section is denoted by V. At that time, in the present embodiment, the ceramic heater 2 satisfies condition <14> that $V \geq D \times 20-21$ [$mm^3$]. As described above, when the glow plug 1 using the ceramic heater 2 is attached to an engine, the conditions specified section projects into a combustion chamber. Since the conditions specified section is cooled by fuel adhering thereto or air flow (swirl) generated within the combustion chamber, the thermal capacity of the conditions specified section affects the ignition performance of the glow plug 1. According to Embodiment 4 to be described later, it was confirmed that when the relation between the volume V of the conditions specified section and the average outer diameter D is such that $V < D \times 20-21$, the performance of starting the engine may deteriorate in a certain environment (e.g., when the environmental temperature is low). Namely, by satisfying condition <14>, the ceramic heater 2 can have a satisfactory engine starting performance even in such an environment.

Figure 5:
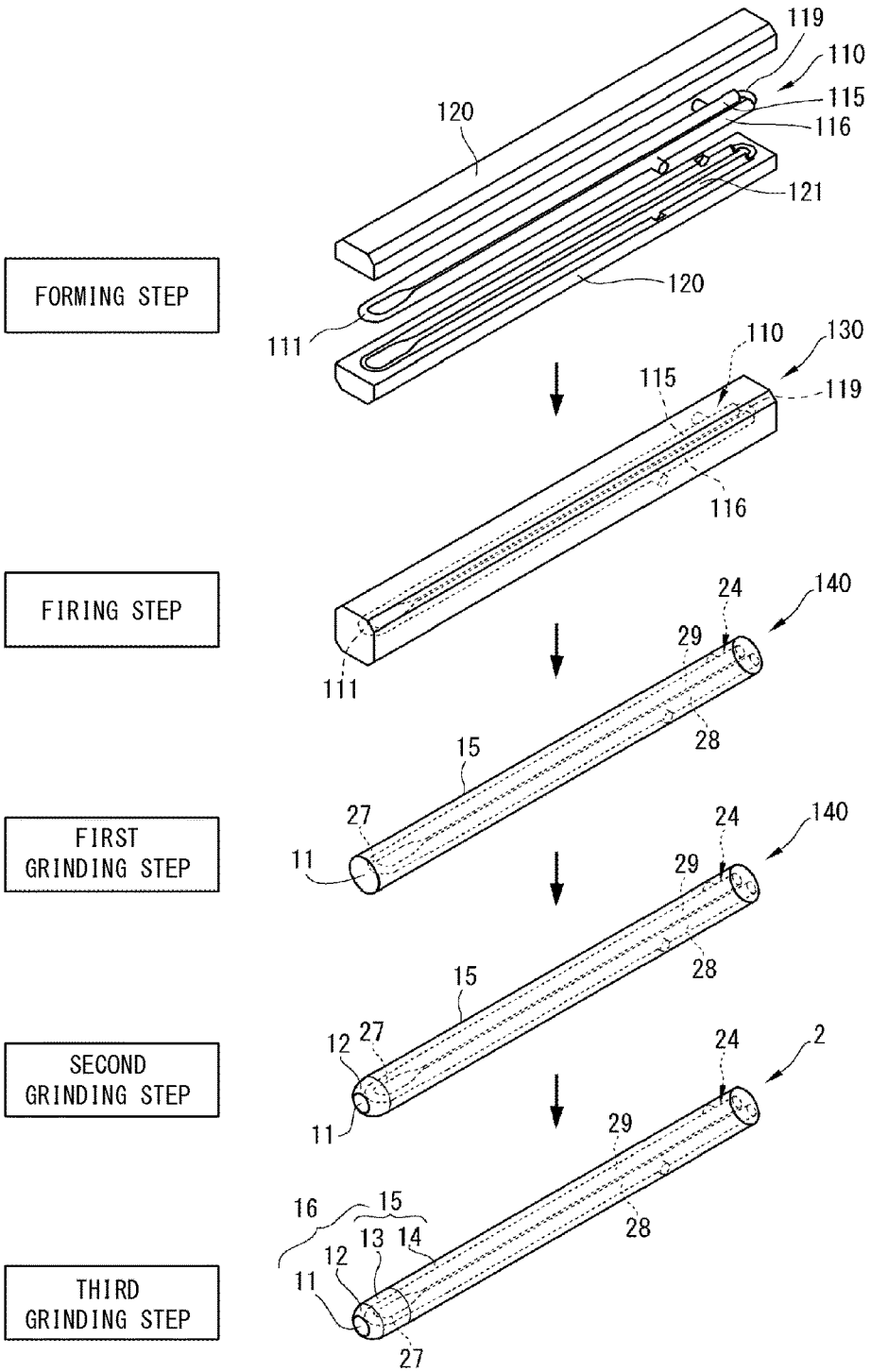
FIG. 5 View showing the steps of manufacturing the ceramic heater 2.

The above-described ceramic heater 2 is generally assembled as follows. First, in a "forming step," as shown in FIG. 5, an element compact 110 which is to become the heat generation resistor 24 of the ceramic heater 2 is formed by injection molding in which electrically conductive ceramic powder, binder, etc. are used as materials. The element compact 110 includes a generally U-shaped green (unfired) heat generation portion 111 and green (unfired) lead portions 115 and 116 which are connected to opposite ends of the heat generation portion 111 and which are generally parallel to each other. A support portion 119 is provided at the ends of the lead portions 115 and 116 so as to connect them together. Thus, the element compact 110 has an annular shape and an increased strength, which facilitates handling of the element compact 110 during manufacture of the ceramic heater 2. The lead portions 115 and 116 have protrusions which are exposed from the side circumferential surface 15 of the substrate 21 after grinding and allow electrical connection with the holding member 8 and the connection ring 85 of the glow plug 1.

Also, green (unfired) substrates 120 are formed by press molding in which powder of insulating ceramic to which additives such as binder have been added is used as a material. The substrates 120 are two plate-shaped half compacts, and recesses 121 for accommodating the element compact 110 are formed on their mating surfaces which face each other. Notably, on the outer surfaces of the substrates 120 opposite the mating surfaces, corner portions extending in the longitudinal directions are chamfered.

The element compact 110 is accommodated in the recesses 121 of the substrates (half compacts) 120 and is sandwiched between the substrates 120. When the resultant assembly is pressed by an unillustrated press machine, the element compact 110 is united with the substrate 120, whereby a composite compact 130 is obtained. The composite compact 130 is heated at 800° C. for 1 hour in a nitrogen atmosphere for debindering. Next, in a "firing step," the composite compact 130 is fired by a known hot press method. The composite compact 130 is sandwiched in the radial direction by unillustrated dies, and is heated while being compressively deformed. At that time, ceramic particles which constitute the substrates 120 of the composite compact 130 grow in the direction perpendicular to the pressing direction. Therefore, their orientation directions are aligned in a plane perpendicular to the pressing direction at the time of the hot press. As a result of the composite compact 130 being fired as described above, a fired body 140 is obtained.

Next, in a "first grinding step," the opposite ends of the fired body 140 are cut, and center less grinding is performed. As a result of cutting of the end which corresponds to the heat generation portion 27 of the heat generation resistor 24 formed through firing of the element compact 110, the forward end surface 11 of the ceramic heater 2 is formed. Also, as a result of cutting of the opposite end, the support portion 119 of the element compact 110 is removed. Subsequently, the outer circumference of the fired body 140 is ground by using a known center less grinder. As a result, the fired body 140 having an octagonal cross section is ground to have a circular cross section, whereby the side circumferential surface 15. Also, the lead portions 28 and 29 are exposed from the side circumferential surface 15.

Next, in a "second grinding step," the taper surface 12 is formed such that the taper surface 12 has the contour L1 extending along the imaginary ellipse E which satisfies the above-described conditions <1> to <7> and <10–1>. Namely, the taper surface 12 is formed by performing R-chamfering which removes the dihedral portion between the forward end surface 11 and the side circumferential surface 15 of the fired body 140.

Subsequently, in a "third grinding step," the first side circumferential surface 13 is formed such that it has the contour L4 which satisfies the above-described conditions <8> and <9>. Namely, the first side circumferential surface 13 is formed by performing taper grinding on a forward end portion of the fired body 140, including the dihedral portion between the taper surface 12 and the side circumferential surface 15, such that the diameter decreases toward the forward end. A portion of the side circumferential surface 15 which remains after formation of the first side circumferential surface 13 is also referred as the second side circumferential surface 14 as described above. As a result of the outer circumferential surface of the fired body 140 being ground through the first through third grinding steps as described above, there is formed the ceramic heater 2 which has a bar-like shape and whose forward end portion 22 has a contour shape satisfying the above-described conditions <1> to <14>.

Notably, the present invention can be modified in various ways. The taper surface 12 is formed by rounding (R-chamfering). However, like a taper surface 112 of a ceramic heater 202 shown in FIG. 6, the taper surface may be formed by ordinary chamfering (C-chamfering). In this case, in order to satisfy the above-described conditions <1> to <4>, the taper surface 112 is desirably formed by forming two or more chamfered surfaces. In the example shown in FIG. 6, the taper surface 112, which constitutes a taper portion 116 together with the forward end surface 11 and the first side circumferential surface 13, is composed of two chamfered surfaces; i.e., a first taper surface 108 located on the forward side with respect to the direction of the axis P and a second taper surface 109 located on the rearward side with respect to the direction of the axis P. The contour of the first taper surface 108 is denoted by L7, and the contour of the second taper surface 109 is denoted by L8.

In the present modification, the taper surface 112 satisfies condition <21> that each of the angle β1 between the contour L2 and the contour L7, the angle β2 between the contour L7 and the contour L8, and the angle β3 between the contour L8 and the contour L4 (L3) is equal to or greater than 145 degrees. Since the orientations of ceramic particles which constitute the substrate 21 are aligned in the direction of the axis P, cracking may start from a dihedral portion formed between adjacent taper surfaces as a result of C-chamfering and grow along the direction of the axis P. In order to suppress occurrence of chipping of the ceramic heater 202 at the taper surface 212, the angle formed between the contours of adjacent taper surfaces which form a dihedral portion therebetween is desirably close to 180 degrees to a possible degree (a state in which no dihedral portion is formed).

According to Example 5 to be described later, it was found that when the angle formed between the contours of adjacent taper surfaces which form a dihedral portion therebetween is less than 145 degrees, cracking may start from the dihedral portion, whereby chipping may occur. Needless to say, this applies even when the taper surface 112 is composed of three or more taper surfaces. Therefore, the taper surface 112 can have a desirable shape when the angle between adjacent contours is equal to or greater than 145 degrees. Notably, the above-mentioned condition <21> can be applied to the dihedral portion which is formed between adjacent surfaces as a result of grinding the forward end surface 11, the taper surface 12, and the first side circumferential surface 13 in the present embodiment. Namely, the angle formed between the contour L2 of the forward end surface 11 and the tangential line of the ellipse E at the end point M1 of the contour L1 of the taper surface 12 is desirably 145 degrees or greater. Similarly, the angle formed between the contour L3 of the first side circumferential surface 13 and the tangential line of the ellipse E at the end point M2 of the contour L1 of the taper surface 12 is desirably 145 degrees or greater. This is effective for preventing chipping of the ceramic heater 202 at the taper surface 112.

Figure 6:
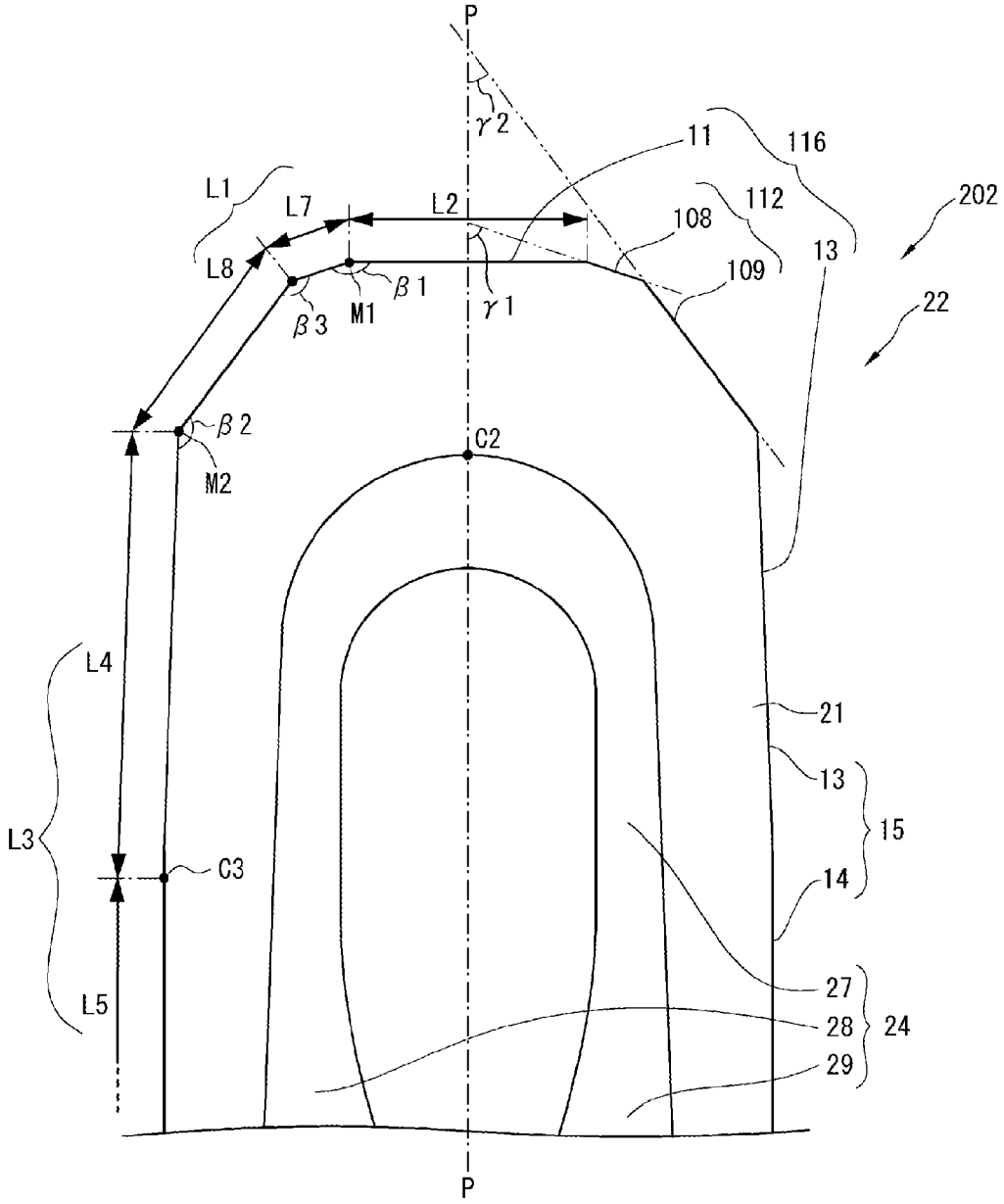
FIG. 6 Enlarged view of a forward end portion 22 of a ceramic heater 202 of a modification which shows the contour of a cross section of the ceramic heater 202 containing the axis P thereof.

Notably, in the above-described modification, the taper surface 112 of the taper portion 116 is formed by C-chamfering. The surface shape of this taper surface 112 can be said to be a shape which satisfies condition <10–2> that the taper surface 112 is composed of a plurality of successive sloping surfaces which differ from one another in the sloping angle with respect to the axis P, and the sloping angle of a forward sloping surface is greater than that of a rearward sloping surface located rearward of the forward sloping surface. Specifically, as shown in FIG. 6, the taper surface 112 is composed of a plurality of successive sloping surfaces (e.g., a first taper surface 108 and a second taper surface 109) which differ from one another in the sloping angle with respect to the axis P. When the sloping angles of these sloping surfaces are compared, the greater the closeness to the forward end with respect to the axis P, the greater the sloping angle. For example, the sloping angle of the first taper surface 108 which is an example of the forward sloping surface formed on the forward side with respect to the axis P is denoted by γ1, and the sloping angle of the second taper surface 109 which is an example of the rearward sloping surface formed on the rear end with respect to the axis P is denoted by γ2. As shown in FIG. 6, the sloping angle γ1 of the first taper surface 108 with respect to the axis P is greater than the sloping angle γ2 of the second taper surface 109 with respect to the axis P. In this example, the taper surface 112 is composed of two sloping surfaces. However, in the case where the taper surface 112 is composed of three or more sloping surfaces, the sloping surfaces are formed such that the sloping angle γ1 of a forward sloping surface becomes greater than the sloping angle γ2 of a rearward sloping surface located rearward of the forward sloping surface. This makes it possible to maintain a diameter close to the outer diameter of the substrate 21 to a position closer to the forward end of the taper surface 112, whereby the outer surface of the substrate 21 can have a sufficiently large area. Accordingly, the heat radiation amount of the ceramic heater 2 can be increased.

Also, in the present embodiment, the taper surface 12 is formed by R-chamfering and satisfies the condition that the contour L1 extends along the imaginary ellipse E. However, the taper surface 12 may be formed by performing C-chamfering and R-chamfering in combination. Also, the contour L1 of the taper surface 12 is not limited to that extending along an ellipse, and may be a contour extending along an imaginary circle. In this case, preferably, the taper surface 12 satisfies the conditions <1> to <4>. Also, in the present embodiment and the modification, the forward end surface 11 is formed at the forward end portion 22 of the ceramic heater 2; however, the forward end surface 11 may be omitted. Even in the case of the ceramic heater in which the forward end surface 11 is omitted, it is confirmed that a satisfactory heat radiation amount and a satisfactory quick temperature raising performance can be secured by satisfying the above-described conditions <11>, <13>, and <14>. Furthermore, the ceramic heater 2 is not limited to that used in the glow plug 1 used for an internal combustion engine or the like, and may be used in a heater used as an appliance or the like.

EXAMPLE 1

An evaluation test was performed in order to confirm that it is possible to obtain a satisfactory quick temperature raising performance while securing a sufficiently large heat radiation amount and a sufficiently large thermal capacity by increasing the wall thickness of the forward end portion 22 of the ceramic heater 2. Notably, in samples of the ceramic heater used in the evaluation test, which will be described below, the taper surface was formed by C-chamfering in order to facilitate manufacture and comparison. Specifically, there were manufactured a plurality of types of ceramic heater fired body having differ diameters within a range of 2.4 to 3.5 mm. Each fired body was grounded by the first grinding step so as to form the forward end surface and the side circumferential surface. Notably, the shortest distance A between the forward end surface and the forward end position C2 of the heat generation resistor is 0.8 mm. In order to facilitate the manufacture, the first side circumferential surface is formed in advance by the third grinding step. Subsequently, in the second grinding step, the dihedral portion between the forward end surface and the first side circumferential surface was grounded by C-chamfering, while the chamfering size was appropriately changed within a range of 0 to 1.3 mm in accordance with the outer diameter, whereby the taper surface was formed. Notably, the chamfering size refers to an amount (width) of chamfering in the radial direction.

For the 22 types of ceramic heater samples manufactured as described above, the diameter of the conditions specified section was measured at intervals of 1 mm so as to obtain the above-mentioned outer diameters D0 to D6. As shown in Table 1, sample 1 to 22 had different average outer diameters D varying within a range of 2.3 to 3.4 mm. For each of samples 1 to 22, the area S1 of the forward end surface was calculated from the outer diameter D0 (i.e., the diameter of the forward end surface). Also, for each of samples 1 to 22, the area S2 of an imaginary circle having a diameter equal to the average outer diameter D was calculated. Further, the ratio S1/S2 was obtained for each of samples 1 to 22. Table 1 shows the obtained ratio S1/S2 in percentage.

TABLE 1

| Sample | Average outer diameter D [mm] | Chamfering size in radial direction [mm] | S1/S2 [×100%] | Heat radiation amount [W] | Time required to reach 1000° C. upon application of 11 V [sec.] | Volume of conditions specified section V [$mm^3$] | Engine started? |
|---|---|---|---|---|---|---|---|
| 1 | ϕ2.3 | 0 | 83 | 12.5 | 0.91 | 24.9 | x |
| 2 | ϕ2.5 | 0.1 | 71 | 13.1 | 0.99 | 29.4 | ○ |
| 3 | | 0.45 | 31 | 12.7 | 0.92 | 28.7 | x |
| 4 | ϕ2.7 | 0.5 | 31 | 13.2 | 1.03 | 33.2 | ○ |
| 5 | | 0.55 | 27 | 13.1 | 0.95 | 33.0 | ○ |
| 6 | | 0.6 | 23 | 12.9 | 0.9 | 32.8 | x |
| 7 | ϕ2.9 | 0.55 | 30 | 13.4 | 1.15 | 38.4 | ○ |
| 8 | | 0.6 | 27 | 13.2 | 1.1 | 38.2 | ○ |
| 9 | | 0.65 | 23 | 12.8 | 1.06 | 38.0 | ○ |
| 10 | | 0.85 | 12 | 12.9 | 1.01 | 37.0 | ○ |
| 11 | | 0.9 | 10 | 12.5 | 0.94 | 36.7 | x |
| 12 | ϕ3.1 | 0.6 | 30 | 13.5 | 1.21 | 43.7 | ○ |
| 13 | | 0.65 | 27 | 13.2 | 1.15 | 43.5 | ○ |
| 14 | | 0.7 | 23 | 12.8 | 1.08 | 43.2 | ○ |
| 15 | | 1.05 | 7 | 12.9 | 1.03 | 41.1 | ○ |
| 16 | | 1.1 | 5 | 12.7 | 0.98 | 40.8 | x |
| 17 | ϕ3.3 | 0.65 | 30 | 13.3 | 1.28 | 49.4 | ○ |
| 18 | | 0.7 | 27 | 13.1 | 1.21 | 49.1 | ○ |
| 19 | | 0.75 | 24 | 12.9 | 1.15 | 48.8 | ○ |
| 20 | | 1.25 | 3 | 12.9 | 1.09 | 45.2 | ○ |
| 21 | | 1.3 | 2 | 12.7 | 1.04 | 44.8 | x |
| 22 | ϕ3.4 | 0.7 | 28 | 13.4 | 1.31 | 51.6 | ○ |

First, the heat radiation amount of each of samples 1 to 22 was obtained by computation. Specifically, imaginary minute sections of a 4 mm portion extending rearward from the position of the forward end surface were obtained by cutting that portion by a plurality of planes perpendicular to the axis P. For each minute section, a heat radiation amount was calculated from the surface area (the area of the outer circumferential surface) and the temperature in accordance with a known computation formula, and the heat radiation amounts of all the minute sections were added together, whereby the heat radiation amount of each sample was obtained. The heat radiation amount can be obtained by adding a quantity Q1(W) of heat transferred to air in contact with the surface of the ceramic heater and a quantity Q2(W) of heat transferred to air as a result of radiation from the surface. The quantity Q1(W) of heat transferred as a result of heat conduction can be obtained by an equation $Q1=hA(T(element)-T(air))$. The quantity Q2(W) of heat transferred as a result of heat radiation can be obtained by an equation $Q2=\sigma\varepsilon A((T(element))^4-(T(air))^4)$. In these equations, h is the heat conductivity of the substrate of the ceramic heater, σ is the Stefan-Boltzmann constant, ε is a thermal emissivity (the emissivity of the substrate of the ceramic heater), and A is the surface area. T(element) is the temperature of the heat generation portion of the heat generation resistor and is obtained in advance from a voltage to be applied to the heat generation resistor. T(gas) is the surface temperature of the substrate of the ceramic heater, and is measured by using a radiation thermometer.

Table 1 shows the calculated heat radiation amounts of samples 1 to 22. In general, a heat radiation amount of 13 W is required to ignite a diesel engine. As shown in Table 1, the heat radiation amounts of samples 1, 3, 6, 9 to 11, 14 to 16, and 19 to 21 were less than 13 W.

Table 1 also shows the results of measurement performed for each of samples 1 to 22 so as to determine the time required to increase the surface temperature to 1000° C. after application of a voltage of 11 V thereof. In general, in order to secure a satisfactory quick temperature raising performance in a diesel engine, the time required to increase the surface temperature to 1000° C. is desirably 1.3 sec or shorter. As shown in Table 1, sample 22 required a time longer than 1.3 sec in order to increase the surface temperature to 1000° C.

Here, attention is paid to sample 1. In sample 1, the chamfering size is 0 mm; namely, no taper surface is formed. Since the average outer diameter D of sample 1 is small (2.3 mm), a sufficiently large surface area required to secure a sufficiently large heat radiation amount cannot be obtained even through no taper surface is formed. Accordingly, the average outer diameter D of the ceramic heater is desirably greater than 2.3 mm.

Meanwhile, sample 22 required 1.31 sec to increase the surface temperature to 1000° C. When samples 18 and 22 are compared, the chamfering size of sample 22 is the same as that of sample 18; however, the average outer diameter D of sample 22 is greater than that of sample 18. As described above, samples 18 and 22 are identical to each other in terms of the design (size and heat generation amount) of the heat generation resistor embedded in the substrate. Therefore, in sample 22 which has a larger average outer diameter D as compared with sample 18, the distance between the heat generation resistor and the outer surface of the substrate is larger than that in sample 18, and the internal thermal capacity of the substrate is greater than that in sample 18. Therefore, sample 22 requires a longer time to increase the temperature within the substrate and transfer the generated heat to the outside, and requires a time longer than 1.3 sec to increase the surface temperature to 1000° C. Therefore, sample 22 fails to provide a satisfactory quick temperature raising performance. Accordingly, the ceramic heater desirably has an average outer diameter D of 3.3 mm or less. It was confirmed from the above that ceramic heaters which satisfy condition <11> can have a satisfactory heat radiation amount and a satisfactory quick temperature raising performance.

EXAMPLE 2

Next, as shown in Table 1, of the samples whose heat radiation amounts were less than 13 W, samples 6, 9 to 11, 14 to 16, and 19 to 21 were less than 27% in the ratio S1/S2. In these samples, the size (diameter) of the forward end surface was not sufficiently large as compared with the average outer diameter D. Namely, the diameter of the forward end portion of the substrate decreases greatly as a result of formation of the taper surface, and a sufficiently large outer diameter cannot be secured in the region where the taper surface is formed. Therefore, these samples failed to have a sufficiently large surface area especially in the region where the taper surface is formed, and failed to have a heat radiation amount of 13 W or greater. It was confirmed from the above that ceramic heaters which satisfy condition <12> can have a sufficiently large heat radiation amount.

Notably, sample 3 has a small average outer diameter D of 2.5 mm. Therefore, when a large taper surface is formed by increasing the chamfering size to 0.45 mm, a sufficiently large surface area required to secure a satisfactory heat radiation amount cannot be obtained. Even though sample 3 is 31% in the ratio S1/S2 and therefore satisfies the condition of the ratio S1/S2 being 27% or greater, sample 3 fails to have a heat radiation amount of 13 W or greater.

EXAMPLE 3

A sample (simulation sample) having an average outer diameter D (2.9 mm) and a chamfering size (0.6 mm) identical with those of sample 8 satisfying the above-described conditions <11> and <12> was fabricated by using a simulator. Further, there were fabricated a plurality of simulation samples by properly changing the shortest distance A between the forward end position C2 (the reference position) of the heat generation resistor and the position of the forward end surface and the shortest distance B between the reference position and the arbitrary position F2 on the taper surface within a range of 0.4 to 1.6 mm. The shortest distance B was adjusted by changing the angle of the C-chamfering with respect to the axis P of the substrate while fixing the chamfering size to 0.6 mm.

The heat radiation amounts of these samples were obtained by adding together the heat transfer quantities Q1 and Q2 calculated for the minute sections obtained by cutting a 4 mm portion extending rearward from the position of the forward end surface. Table 2 shows the results of the computation.

TABLE 2

| | | A [mm] | | | | | | |
|---|---|---|---|---|---|---|---|---|
| | | 0.4 | 0.6 | 0.8 | 1.0 | 1.2 | 1.4 | 1.6 |
| B [mm] | 0.4 | 12.9 | | | | | | |
| | 0.6 | 13.1 | 12.9 | 12.7 | | | 12.8 | |
| | 0.8 | 13.2 | 13.0 | 12.8 | | | | |
| | 1.0 | | | 13.1 | 12.8 | | 12.9 | |
| | 1.2 | 13.2 | 13.1 | 13.1 | 13.1 | 12.9 | | |
| | 1.4 | | | | | 13.0 | | |
| | 1.6 | 13.3 | 13.2 | 13.2 | | 13.0 | 13.0 | 12.9 |

As shown in Table 2, the heat radiation amounts of the simulation samples in which the distance B was equal to or less than the distance A were less than 13 W. When B≤A, the thickness (in the radial direction) of the forward end portion of the substrate becomes small as compared with the case where B>A. Namely, the outer diameter of the substrate decreases in the region where the taper surface is formed. Thus, the surface area of the forward end portion of the substrate decreases, and the heat transfer quantity Q1 decreases. Therefore, it becomes impossible to secure a heat radiation amount (13 W or greater) required for securing a satisfactory ignition performance at the time of startup of a diesel engine. It was confirmed from the above that ceramic heaters which satisfy condition <13> can have a sufficiently large heat radiation amount.

EXAMPLE 4

Next, the relation between the volume V of the conditions specified section and the average outer diameter D was evaluated. As shown in Table 1, the volume V [$mm^3$] of the conditions specified section (a 6 mm portion extending rearward from the position of the forward end surface) of each of samples 1 to 22 was obtained. Notably, the volume V can be obtained by, for example, measuring the outer diameter at intervals of 0.1 mm up to a position separated 6 mm away from the forward end surface, and adding together the volumes of circular columns having the measured outer diameters.

A glow plug into which each of samples 1 to 22 was assembled was attached to a diesel engine for test use, and an engine starting test was performed in a low temperature environment (−20° C.). At that time, simultaneously with the start of supply of electricity to the glow plug for preheating (supply of electricity for raising temperature), cranking (starting by a sel-motor) of the engine was performed. Namely, the engine starting test is a low temperature starting test performed in a state in which the power for supplying electricity for the purpose of preheating is unstable because electric power is used for starting the sel-motor. Samples 2, 4, 5, 7 to 10, 12 to 15, 17 to 20, and 22 were able to start the engine in such a state, and are indicated by "o " in Table 1. Samples (1, 3, 6, 11, 16, 21) which were unable to start the engine are indicated by "x" in Table 1.

Figure 7:
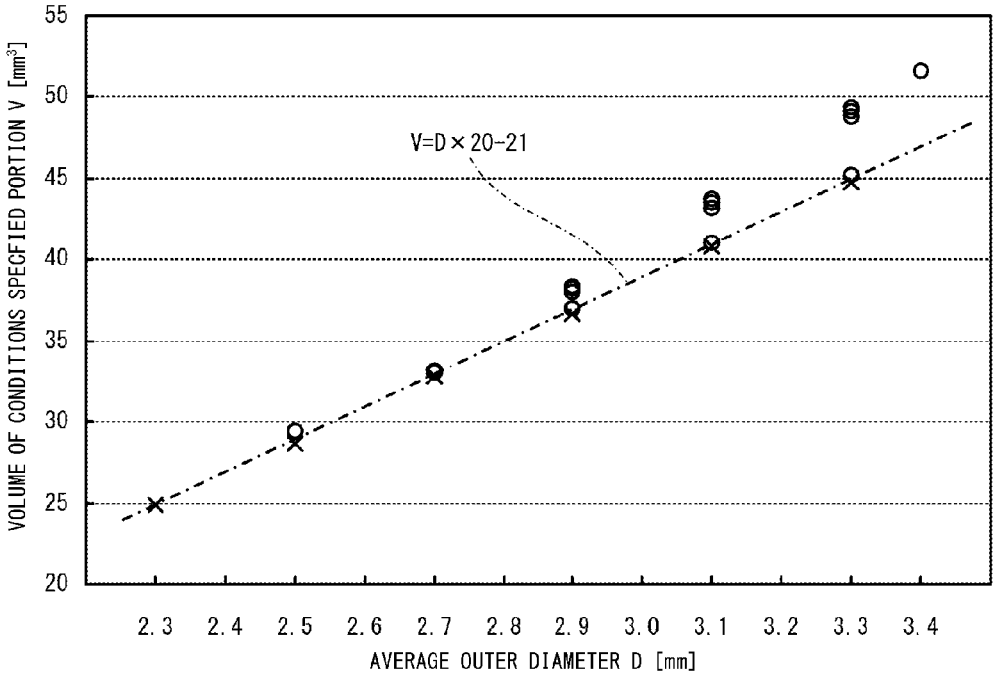
FIG. 7 Graph showing the relation between volume V and average outer diameter D in a conditions specified section.

Similarly, the results of the starting test are indicated by "o" and "x" in the graph of FIG. 7, in which the vertical axis represents the volume V of the conditions specified section, and the horizontal axis represents the average outer diameter D. As is clear from the graph of FIG. 7, the volume V of the conditions specified section required to start the engine in the above-mentioned low temperature environment changes in accordance with the average outer diameter D. The inventors derived from the graph a relational expression "V=D×20−21 which represents the relation between the volume V of the conditions specified section and the average outer diameter D.

Since samples which satisfy the condition of V≥D×20−21 have a sufficiently large volume at the conditions specified section, their thermal capacities are large as compared with samples which fail to satisfy the condition. Therefore, it is possible to reduce a possibility that in the above-described low temperature environment, cooling of the ceramic heater greatly and immediately affects the temperature drop of the heat generation resistor. Accordingly, it was confirmed that ceramic heaters which satisfy condition <14> can satisfactorily start the engine even in a low temperature environment in a state in which electric power is unstable due to the above-mentioned preheating, and can have a sufficiently large thermal capacity at the conditions specified section.

EXAMPLE 5

Next, an evaluation test was performed in order to confirm that occurrence of chipping can be suppressed by forming the taper surface 112 of the ceramic heater 202 by C-chamfering and by specifying the angle formed between the contours of a dihedral portion formed on the forward end portion. In this evaluation test, samples of four types of ceramic heaters were manufactured from fired body used for manufacturing the above-mentioned sample 8 having a chamfering size of 0.6 mm and an average outer diameter D of 2.9 mm. The samples of the four types of ceramic heaters were manufactured such that the angle formed between the contours of the dihedral portion formed on the taper surface became 90°, 135°, 145°, and 151° respectively. The 90° samples are samples for which only the first grinding step was performed and the taper surface and the first side circumferential surface were not formed. The 135° samples are identical with the above-mentioned sample 8 in which the first side circumferential surface was formed in advance in the third grinding step, and the forward end surface was chamfered by single-step C-chamfering in the second grinding step such that a taper surface having an inclination angle of 45° was formed. Similarly, the 145° and 151° samples are samples in which the first side circumferential surface was formed in advance in the third grinding step, and the forward end surface was chamfered by two-step C-chamfering such that each of the angles β1 and β3 shown in FIG. 6 became 145° and 151° respectively. Notably, in either case, the first side circumferential surface was formed such that the angles β2 became 145° or greater. 200 samples were prepared for each of the four types of ceramic heaters.

A Charpy impact test was performed for these ceramic heater samples by using a known Charpy tester. An impact energy to be applied to each sample in the Charpy impact test was set under the assumption that the maximum height of fall or drop of a glow plug during manufacture thereof or at the time of attachment thereof to an engine is 50 cm. Specifically, for 100 samples of each of the four types, an impact energy corresponding to that acting on a sample when it is dropped from a height of 2.5 m (safety factor: 5) was applied to the forward end portion of each sample. Similarly, for 100 samples of each of the four types, an impact energy corresponding to that acting on a sample when it is dropped from a height of 10 m was applied to the forward end portion of each sample. After the test, each sample was observed so as to check occurrence of chipping, the number of samples having chipped was counted, and the ratio of samples having chipped was obtained. The results of this test are shown in the graph of FIG. 8.

Figure 8:
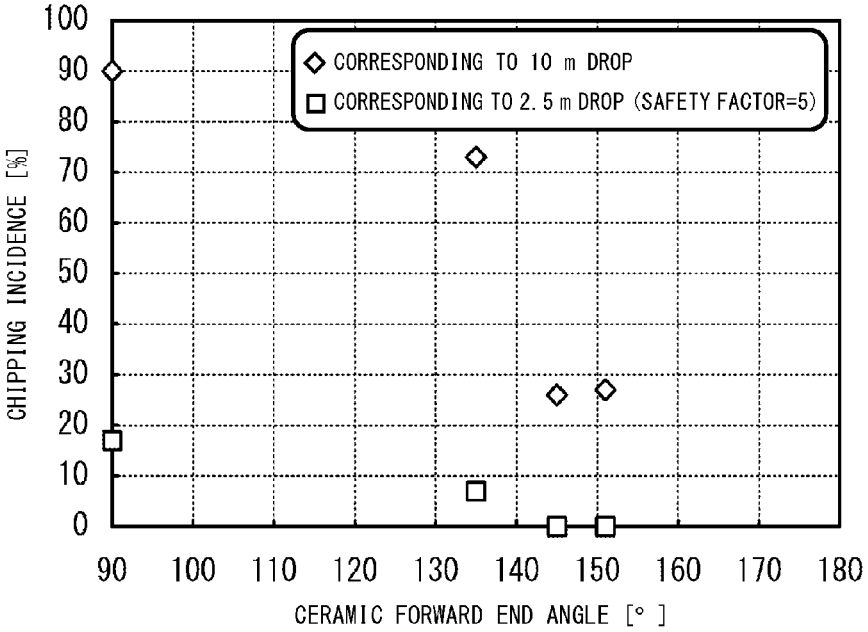
FIG. 8 Graph showing the results of an impact test performed on the forward end portion 22 of the ceramic heater 2.

As shown in FIG. 8, in the impact test in which an impact energy corresponding to a 10 m drop was applied to each sample, 90% of the 90° samples chipped, and 73% of the 135° samples chipped. Also, 26% of the 145° samples and 27% of the 151° samples chipped upon application of the impact energy corresponding to the 10 m drop. However, the number (ratio) of the samples having chipped was considerably small as compared with the 90° and 135° samples. Meanwhile, in an impact test in which an impact energy corresponding to a 2.5 m drop was applied to each sample, 17% of the 90° samples chipped. Although 7% of the 135° samples chipped, the 145° samples and the 151° samples did not chip. The results of this Charpy impact test demonstrate that in the case where the taper surface of the ceramic heater is formed by C-chamfering, if the taper surface is formed such that the angle between the contours of the dihedral portion formed on the forward end portion becomes 145 degrees or greater, chipping of the ceramic heater at the taper surface can be prevented to a sufficient degree.

The invention claimed is:

1. A ceramic heater comprising:

a columnar substrate made of insulating ceramic and extending in a direction of an axis, the substrate having a forward end, a rear end and a forward end portion, the forward end and the rear end being located at opposite ends of the substrate in the direction of the axis, and the forward end portion being a portion of the substrate extending rearward from the forward end in the direction of the axis; and a heat generation resistor made of electrically conductive ceramic, embedded in the substrate, and generating heat upon supply of electricity thereto, the heat generation resistor having a heat generation portion disposed in the forward end portion of the substrate and lead portions extending toward the rear end of the substrate from opposite ends of the heat generation portion, the heat generation portion having a forward end position which is a position of the heat generation portion being closest to the forward end of the columnar substrate, wherein the forward end portion of the substrate has a taper portion formed such that a diameter of the taper portion decreases toward the forward end of the substrate with respect to the direction of the axis;

the taper portion has an outer circumferential surface which is composed of a plurality of curved surfaces which bulge outward and respectively have a plurality of different radiuses of curvature, the plurality of curved surfaces being successively arranged in the direction of the axis such that a radius of curvature of the taper portion changes continuously in the direction of the axis; and of the plurality of curved surfaces, a forward curved surface formed on a forward side with respect to the direction of the axis is smaller in radius of curvature than a rearward curved surface formed rearward of the forward curved surface with respect to the direction of the axis, wherein the ceramic heater satisfies a condition of $2.3<D\leq3.3$, where D (mm) represents an average outer diameter of the substrate in a portion thereof which extends 6 mm rearward from a position of the forward end of the substrate with respect to the direction of the axis, wherein the taper portion has a flat forward end surface that is perpendicular to the direction of the axis, a side circumferential surface which surrounds the axis in a circumferential direction, and a taper surface which is composed of the plurality of curved surfaces and which connects the forward end surface and the side circumferential surface so as to form a taper shape, and wherein, when a cross section of the substrate containing the axis is viewed:

a first contour, which is the contour of the taper surface of the taper portion, is such that a first end point at which the first contour is connected to a second contour, which is the contour of the flat forward end surface, is located forward in the direction of the axis of a second end point at which the first contour is connected to a third contour, which is the contour of the side circumferential surface, and is located inward of the second end point in a radial direction perpendicular to the direction of the axis, a distance between the first end point and the second end point in the direction of the axis is greater than a distance between the first end point and the second end point in the radial direction, and a first angle between the axis and a first tangential line of the first contour at a position near the first end point is greater than a second angle between the axis and a second tangential line of the first contour at a position near the second end point.

2. The ceramic heater according to claim 1, which satisfies a condition of B>A, where, on a cross section of the substrate containing the axis, A represents a shortest distance between a position of the forward end of the substrate and the forward end position of the heat generation portion of the heat generation resistor, and B represents a shortest distance between the reference position and an arbitrary position on the plurality of curved surfaces which forms the outer circumferential surface of the taper portion.

3. The ceramic heater according to claim 1, which satisfies a condition of $V \geq (D \times 20) - 21$ where V ($mm^3$) represents a volume of the ceramic heater in the portion thereof which extends 6 mm rearward from the position of the forward end of the substrate with respect to the direction of the axis, and D (mm) represents the average outer diameter of the substrate in the portion thereof which extends 6 mm rearward from the position of the forward end of the substrate with respect to the direction of the axis.

4. The ceramic heater according to claim 1, wherein, when an imaginary ellipse which has a major axis coinciding with the axis and which passes through the first end point and the second end point is disposed on a cross section of the substrate containing the axis, the first contour extends along the imaginary ellipse.

5. The ceramic heater according to claim 4, wherein a position of the center of the imaginary ellipse disposed on the cross section of the substrate containing the axis is located rearward of a position of the forward end of the heat generation resistor with respect to the direction of the axis.

6. The ceramic heater according to claim 4, wherein, when the imaginary ellipse is disposed on the cross section of the substrate containing the axis, the imaginary ellipse is disposed on each of the opposite sides of the axis with respect to the radial direction such that two imaginary ellipses are spaced from each other.

7. The ceramic heater according to claim 1, wherein the third contour includes a fourth contour which extends from the second end point toward the rear side with respect to the direction of the axis while expanding in the radial direction, and a fifth contour which extends from the fourth contour in parallel with the direction of the axis;

the second end point is disposed forward of the position of the forward end of the heat generation resistor with the direction of the axis; and a connection point between the fourth contour and the fifth contour is located rearward of the position of the forward end portion of the heat generation resistor with the direction of the axis.

8. The ceramic heater according to claim 1, which satisfies a condition of $S1/S2 \times 100 \geq 27$, where S1 represents an area of the forward end surface, and S2 represents an area of a circle which has a diameter equal to an average outer diameter of the substrate in a portion thereof which extends 6 mm rearward from the position of the forward end of the substrate with respect to the direction of the axis.

9. The ceramic heater according to claim 1, wherein the third contour is connected to a fourth contour at a third end point, the fourth contour being located rearward in the direction of the axis relative to the third contour, wherein the forward end position of the heat generation portion is located forward in the direction of the axis of the third end point, and the forward end position of the heat generation portion is located rearward in the direction of the axis of the second end point, wherein, in the direction of the axis, a rate of decrease of the decrease of the diameter of the taper portion toward the forward end of the substrate with respect to the direction of the axis for is greater for the first contour than the third contour, and wherein the fourth contour is not tapered in the direction of the axis.

10. A ceramic heater comprising:

a columnar substrate made of insulating ceramic and extending in a direction of an axis, the substrate having a forward end, a rear end and a forward end portion, the forward end and the rear end being located at opposite ends of the substrate in the direction of the axis, and the forward end portion being a portion of the substrate extending rearward from the forward end in the direction of the axis; and a heat generation resistor made of electrically conductive ceramic, embedded in the substrate, and generating heat upon supply of electricity thereto, the heat generation resistor having a heat generation portion disposed in the forward end portion of the substrate and lead portions extending toward the rear end of the substrate from opposite ends of the heat generation portion, the heat generation portion having a forward end position which is a position of the heat generation portion being closest to the forward end of the columnar substrate, wherein the forward end portion of the substrate has a taper portion formed such that a diameter of the taper portion decreases toward the forward end of the substrate with respect to the direction of the axis;

the taper portion has an outer circumferential surface which is composed of a plurality of sloping surfaces which respectively have a plurality of different sloping angles with respect to the axis and which are arranged along the direction of the axis; and of the plurality of sloping surfaces, a forward sloping surface formed on a forward side with respect to the direction of the axis is greater in sloping angle than a rear sloping surface formed rearward of the forward sloping surface with respect to the direction of the axis, wherein the ceramic heater satisfies a condition of $2.3 < D \leq 3.3$, where D (mm) represents an average outer diameter of the substrate in a portion thereof which extends 6 mm rearward from a position of the forward end of the substrate with respect to the direction of the axis, wherein the taper portion has a flat forward end surface perpendicular to the direction of the axis, a side circumferential surface which surrounds the axis in a circumferential direction, and a taper surface which is composed of the plurality of sloping surfaces and which connects the forward end surface and the side circumferential surface so as to form a taper shape; and wherein, when a cross section of the substrate containing the axis is viewed:

a first contour which is the contour of the taper surface of the taper portion is such that a first end point at which the first contour is connected to a second contour which is the contour of the forward end surface is located forward in the direction of the axis of a second end point at which the first contour is connected to a third contour which is the contour of the side circumferential surface, and is located inward of the second end point in a radial direction perpendicular to the direction of the axis, a first distance between the first end point and the second end point in the direction of the axis is greater than a second distance between the first end point and the second end point in the radial direction, and a first angle between the axis and a first tangential line of the first contour at a first position near the first end point is greater than a second angle between the axis and a second tangential line of the first contour at a second position near the second end point, and wherein a third angle formed between a plurality of lines which constitute the first contour, a fourth angle formed between the second contour and the first contour at the first end point, and a fifth angle formed between the third contour and the first contour at the second end point are all 145 degrees or greater.

11. The ceramic heater according to claim 10, which satisfies a condition of B>A, where, on a cross section of the substrate containing the axis, A represents a shortest distance between the position of the forward end of the substrate and a reference position which is a position of a forward end of the heat generation resistor, and B represents a shortest distance between the reference position and an arbitrary position on the plurality of sloping surfaces which forms the outer circumferential surface of the taper portion.

12. The ceramic heater according to claim 10, which satisfies a condition of $V \geq (D \times 20) - 21$ where V ($mm^3$) represents a volume of the ceramic heater in the portion thereof which extends 6 mm rearward from the position of the forward end of the substrate with respect to the direction of the axis.

13. A method of manufacturing the ceramic heater according to claim 1, the method comprising:

a first grinding step of grinding a side surface and an end surface of a columnar fired body in which the substrate and the heat generation resistor are fired and united, to thereby form the side circumferential surface parallel to the axis and the forward end surface perpendicular to the axis;

a second grinding step of grinding a dihedral portion formed between the forward end surface and the side circumferential surface of the fired body to thereby form the taper surface; and a third grinding step of grinding a forward end portion of the side circumferential surface including a portion thereof which is connected to the taper surface, so as to form the taper shape such that the diameter decreases toward the forward end.

* * * * *